US008212800B2

(12) United States Patent
Ishii

(10) Patent No.: US 8,212,800 B2
(45) Date of Patent: Jul. 3, 2012

(54) ELECTRO-OPTIC DEVICE, DRIVING METHOD, AND ELECTRONIC APPARATUS

(75) Inventor: Ryo Ishii, Tokyo (JP)

(73) Assignee: Seiko Epson Corporation, Tokyo (JP)

( * ) Notice: Subject to any disclaimer, the term of this patent is extended or adjusted under 35 U.S.C. 154(b) by 528 days.

(21) Appl. No.: 12/431,414

(22) Filed: Apr. 28, 2009

(65) Prior Publication Data

US 2009/0278829 A1 Nov. 12, 2009

(30) Foreign Application Priority Data

May 12, 2008 (JP) ..... 2008-124366
Dec. 19, 2008 (JP) ..... 2008-323313

(51) Int. Cl.
*G09G 5/00* (2006.01)

(52) U.S. Cl. ..... 345/208; 345/76

(58) Field of Classification Search ..... 345/60, 345/63, 87, 89, 94, 97, 98, 100, 208, 690, 345/691, 692
See application file for complete search history.

(56) References Cited

U.S. PATENT DOCUMENTS 4,941,045 A * 7/1990 Birch ..... 348/448
6,262,771 B1 * 7/2001 Higurashi et al. ..... 348/441
6,380,985 B1 * 4/2002 Callahan ..... 348/607
6,504,310 B2 * 1/2003 Naka et al. ..... 315/169.1
6,903,716 B2 * 6/2005 Kawabe et al. ..... 345/99
7,119,771 B2 * 10/2006 Yoneda et al. ..... 345/87
7,218,300 B2 * 5/2007 Shimizu ..... 345/87
7,495,646 B2 * 2/2009 Kawabe et al. ..... 345/95
7,965,270 B2 * 6/2011 Kawabe et al. ..... 345/89
2002/0036611 A1 * 3/2002 Ishii ..... 345/89
2003/0137499 A1 * 7/2003 Iisaka ..... 345/204

FOREIGN PATENT DOCUMENTS

JP A-2003-114661 4/2003

* cited by examiner

*Primary Examiner* — Amare Mengistu
*Assistant Examiner* — Stacy Khoo
(74) *Attorney, Agent, or Firm* — Oliff & Berridge, PLC

(57) ABSTRACT

An electro-optic device which includes pixels disposed in regions corresponding to intersections between a plurality of scanning lines (Rreal) and a plurality of data lines, the pixels being turned on or off in accordance with data signals, each of the data signals being supplied to the plurality of data lines when the plurality of scanning lines (Rreal) are selected, in which one field is divided into a plurality of sub-fields (Nsf) and the plurality of sub-fields (Nsf) are classified into a first group having a period length formed by equally dividing the one field into a plurality of slots, such that a number of slots in the one field is a division number (Ndiv), and a second group having a period length that is at least four times longer than a period length the first group.

10 Claims, 17 Drawing Sheets

FIG. 7

<SCANNING LINE SELECTION SEQUENCE>

| | FIRST GROUP | | | | | | | | | | | | | | | |
|---|---|---|---|---|---|---|---|---|---|---|---|---|---|---|---|---|
| | sf1 | | | | sf2 | | | | sf3 | | | | sf4 | | | |
| L7 | 60 | 61 | | 74 | 75 | 76 | | 89 | 90 | 91 | | 104 | 105 | 106 | | 119 |
| L6 | 120 | 121 | | 134 | 135 | 136 | | 149 | 150 | 151 | | 164 | 165 | 166 | | 179 |
| L5 | 180 | 181 | | 194 | 195 | 196 | | 209 | 210 | 211 | | 224 | 225 | 226 | | 239 |
| L4 | 195 | 196 | | 209 | 210 | 211 | | 224 | 225 | 226 | | 239 | 240 | 1 | | 14 |
| L3 | 210 | 211 | | 224 | 225 | 226 | | 239 | 240 | 1 | | 14 | 15 | 16 | | 29 |
| L2 | 225 | 226 | | 239 | 240 | 1 | | 14 | 15 | 16 | | 29 | 30 | 31 | | 44 |
| L1 | 240 | 1 | | 14 | 15 | 16 | | 29 | 30 | 31 | | 44 | 45 | 46 | | 59 |

TIME

| SECOND GROUP | | | | | | | | | | | | | | | |
|---|---|---|---|---|---|---|---|---|---|---|---|---|---|---|---|
| sf5 | | | | | sf6 | | | | | sf7 | | | | | |
| 120 | 121 | 122 | | 179 | 180 | 181 | 182 | | 239 | 240 | 1 | 2 | | 59 |
| 180 | 181 | 182 | | 239 | 240 | 1 | 2 | | 59 | 60 | 61 | 62 | | 119 |
| 240 | 1 | 2 | | 59 | 60 | 61 | 62 | | 119 | 120 | 121 | 122 | | 179 |
| 15 | 16 | 17 | | 74 | 75 | 76 | 77 | | 134 | 135 | 136 | 137 | | 194 |
| 30 | 31 | 32 | | 89 | 90 | 91 | 92 | | 149 | 150 | 151 | 152 | | 209 |
| 45 | 46 | 47 | | 104 | 105 | 106 | 107 | | 164 | 165 | 166 | 167 | | 224 |
| 60 | 61 | 62 | | 119 | 120 | 121 | 122 | | 179 | 180 | 181 | 182 | | 239 |

TIME

FIG. 9

| Ndiv | WEIGHT sf | | NUMBER sf | | Ys | Rvir | Trow (ns) |
|---|---|---|---|---|---|---|---|
| | Wsf1 | Wsf2 | Nsf1 | Nsf2 | | | |
| 3 | 1 | 2 | 1 | 1 | 360 | 1080 | 7716.05 |
| 4 | 1 | 2 | 2 | 1 | 270 | 1080 | 5144.03 |
| ⋮ | ⋮ | ⋮ | ⋮ | ⋮ | ⋮ | ⋮ | ⋮ |
| 255 | 1 | 16 | 15 | 15 | 5 | 1275 | 435.73 |
| 256 | 1 | 16 | 16 | 15 | 5 | 1280 | 420.03 |
| 271 | 1 | 16 | 15 | 16 | 4 | 1084 | 495.97 |
| 272 | 1 | 16 | 16 | 16 | 4 | 1088 | 478.71 |
| 288 | 1 | 17 | 16 | 16 | 4 | 1152 | 452.11 |
| 289 | 1 | 17 | 17 | 16 | 4 | 1156 | 436.89 |
| ⋮ | ⋮ | ⋮ | ⋮ | ⋮ | ⋮ | ⋮ | ⋮ |
| 341 | 1 | 18 | 17 | 18 | 4 | 1364 | 349.11 |
| 342 | 1 | 18 | 18 | 18 | 4 | 1368 | 338.42 |
| 360 | 1 | 19 | 18 | 18 | 3 | 1080 | 428.67 |
| 361 | 1 | 19 | 19 | 18 | 3 | 1083 | 415.93 |
| 379 | 1 | 19 | 18 | 19 | 3 | 1137 | 396.17 |
| 380 | 1 | 19 | 19 | 19 | 3 | 1140 | 384.73 |
| ⋮ | ⋮ | ⋮ | ⋮ | ⋮ | ⋮ | ⋮ | ⋮ |
| 528 | 1 | 23 | 22 | 23 | 3 | 1584 | 239.13 |
| 529 | 1 | 23 | 23 | 22 | 3 | 1587 | 233.38 |
| 551 | 1 | 23 | 22 | 23 | 2 | 1102 | 336.09 |
| 552 | 1 | 23 | 23 | 23 | 2 | 1104 | 328.19 |
| 575 | 1 | 24 | 23 | 23 | 2 | 1150 | 315.06 |
| 576 | 1 | 24 | 24 | 23 | 2 | 1152 | 307.82 |
| ⋮ | ⋮ | ⋮ | ⋮ | ⋮ | ⋮ | ⋮ | ⋮ |
| 1055 | 1 | 32 | 31 | 32 | 2 | 2110 | 125.38 |
| 1056 | 1 | 32 | 32 | 32 | 2 | 2112 | 123.30 |
| 1088 | 1 | 33 | 32 | 32 | 1 | 1088 | 239.35 |
| 1089 | 1 | 33 | 33 | 32 | 1 | 1089 | 235.45 |
| 1121 | 1 | 33 | 32 | 33 | 1 | 1121 | 228.73 |
| 1122 | 1 | 33 | 33 | 33 | 1 | 1122 | 225.07 |
| ⋮ | ⋮ | ⋮ | ⋮ | ⋮ | ⋮ | ⋮ | ⋮ |

Ys : NUMBER OF REFERENCE INTERACED SCANNING LINES
Rvir : NUMBER OF VIRTUAL SCANNING LINES
Trow : SCANNING LINE SELECTION TIME

ELECTRO-OPTIC DEVICE, DRIVING METHOD, AND ELECTRONIC APPARATUS

CROSS-REFERENCE TO RELATED APPLICATIONS

This application claims priority to JP 2008-124366 filed in Japan on May 12, 2008, and to JP 2008-323313 filed in Japan on Dec. 19, 2008, the entire disclosures of which are hereby incorporated by reference in their entirety.

BACKGROUND

1. Technical Field

The present invention relates to a technique capable of expressing gray scales by turning on or off pixels in plural sub-fields into which one field is divided.

2. Related Art

When gray scales are expressed in an electro-optic device including a display element such as a liquid crystal element or an organic EL element, the following technique was suggested. That is, the technique was suggested in which one field is divided into plural sub-field and intermediate gray scales are expressed by turning on or off display elements in the divided sub-fields and varying a ratio of periods in which pixels in one field are in an ON (off) state (JP-A-2003-114661).

However, in this technique, the number of sub-fields into which one field is divided has to be increased in order to increase the number of displayable gray scales. In addition, when the number of sub-fields is increased, sufficient selection time of scanning lines may not be ensured or driving frequency has to be increased.

SUMMARY

An advantage of some aspects of the invention is that it provides an electro-optic device capable of increasing the number of displayable gray scales and ensuring sufficient selection time of scanning lines, when an ON/OFF state is made in sub-fields.

According to an aspect of the invention, there is provided an electro-optic device includes pixels provided in correspondence with intersections between a number Rreal of plural scanning lines and plural data lines and turned on or off in accordance with data signals each supplied to the data lines when the scanning lines are selected. In the electro-optic device, one field is divided into a number Nsf of plural sub-fields and the number Nsf of sub-fields are classified into a first group having a period length formed by equally dividing one field into plural Ndiv and a second group having a period length corresponding to plural times of the sub-field of the first group. In the electro-optic device, gray scales are controlled in one field unit by turning on or off the pixels in each of the number Nsf of sub-fields. The electro-optic device includes: a scanning line driving circuit which, on the assumption of a number Rvir (where Rvir≧Rreal) of virtual scanning lines including the number Rreal of scanning lines, performs interlaced scanning on the number Rvir of virtual scanning lines by the number of lines according to a ratio of the period lengths of the sub-fields arranged in one field; and a data line driving circuit which supplies the data signals to the pixels located in selected scanning lines through the data lines. When two different values obtained as division number Ndiv of the one field are compared to each other, the division number Ndiv is selected such that a number Ys of reference interlaced scanning lines is smaller in the interlaced scanning and a selection period obtained by dividing the one field period by the product of the number Nsf of sub-fields and the number Rvir of virtual scanning lines is longer. With such a configuration, it is possible to increase the number of displayable gray scales and ensure sufficient selection time of the scanning lines.

In the electro-optic device according to this aspect of the invention, the division number Ndiv in which the selection period is longer may be larger than the division number Ndiv in which the selection period is shorter.

In the electro-optic device according to this aspect of the invention, when a value obtained by dividing the number Rreal by the division number Ndiv does not have a decimal fraction, the value may be determined as the number Ys of reference interlaced scanning lines, and when a value obtained by dividing the number Rreal by the division number Ndiv has a decimal fraction, an integer value obtained by rounding up the value to the left of the decimal point is determined as the number Ys of reference interlaced scanning lines. The number Rvir of virtual scanning lines may be equal to Ndiv×Ys). Assuming that a weight Wsf1 of the period length of the sub-fields belonging to the first group is 1, an integer value obtained by rounding off a square root of the division number Ndiv to the left of the decimal point may be determined as a weight Wsf2 of the period lengths of the sub-fields belonging to the second group. Assuming that the number of sub-fields belonging to the first group is Nsf1 and the number of sub-fields belonging to the second group is Nsf2, the number Nsf2 of sub-fields belonging to the second group may be equal to {(Ndiv/Wsf2)−1} (where an integer value obtained by rounding up a result value of (Ndiv/Wsf2)−1 to the left of the decimal point is used) and the number Nsf1 of sub-fields belonging to the first group is equal to {Ndiv−Wsf2×Nsf2}, and thus the number Nsf of sub-fields is equal to (Nsf1+Nsf2).

In the electro-optic device according to this aspect of the invention, the period length of an ON state or an OFF state may be set in accordance with a gray scale level so that the sub-fields which becomes the ON state or the OFF state from a predetermined reference position in a direction getting away from the predetermined reference position continue.

In the electro-optic device according to this aspect of the invention, at least one sub-field among the number Nsf of sub-fields may be normally in the OFF state or the ON state.

In the electro-optic device according to this aspect of the invention, first voltage may be used as ON voltage of the sub-fields belonging to the first group, and the first voltage and second voltage higher than the first voltage are used as On voltage of the sub-fields belonging to the second group. The second voltage may be used in two or more sub-fields which are most distant from the reference position among the sub-fields belonging to the second group and continue in a direction facing the reference position from the sub-field most distant from the reference position. The expression characteristic can be improved with a dark display.

According to another aspect of the invention, there is provided an electronic apparatus including the electro-optic device having the configuration described above.

BRIEF DESCRIPTION OF THE DRAWINGS

The invention will be described with reference to the accompanying drawings, wherein like numbers reference like elements.

FIG. 7 is a diagram illustrating a selection sequence of the scanning lines in the electro-optic device;

FIG. 9 is a diagram illustrating a relation between the division number of a field and selection time of the scanning lines;

DETAILED DESCRIPTION OF EMBODIMENTS

First the configuration of an electro-optic device and a method of driving the electro-optic device will be described with reference to an embodiment.

Figure 1:
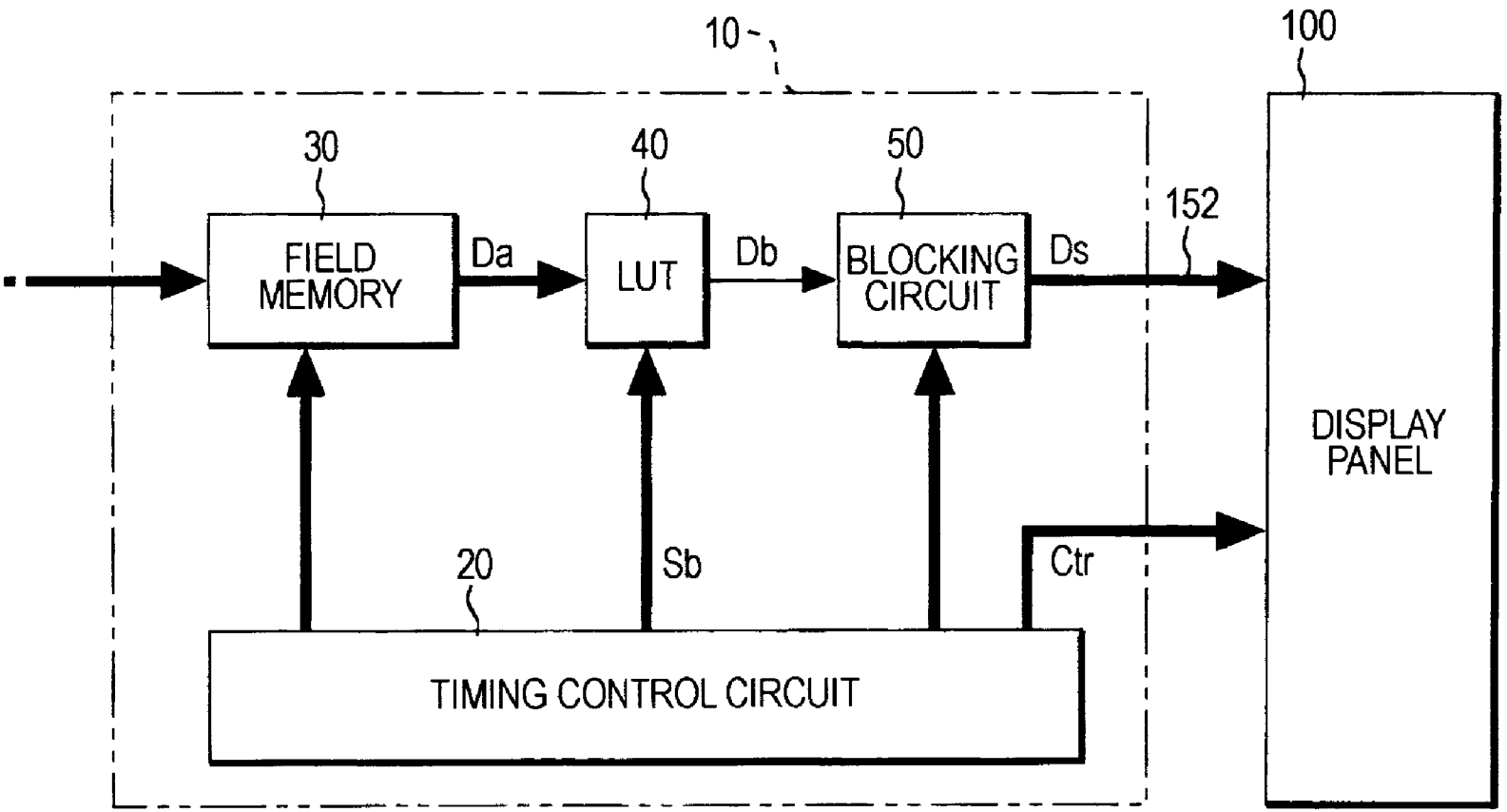
FIG. 1 is a block diagram illustrating the configuration of an electro-optic device according to an embodiment of the invention.

FIG. 1 is a block diagram illustrating the system configuration of the electro-optic device according to the embodiment of the invention. As shown in FIG. 1, the electro-optic device includes a display control circuit 10 and a display panel 100. The display control circuit 10 controls the display panel 100.

For convenient description, the configuration of the display panel 100 will be described with reference to FIG. 2.

Figure 2:
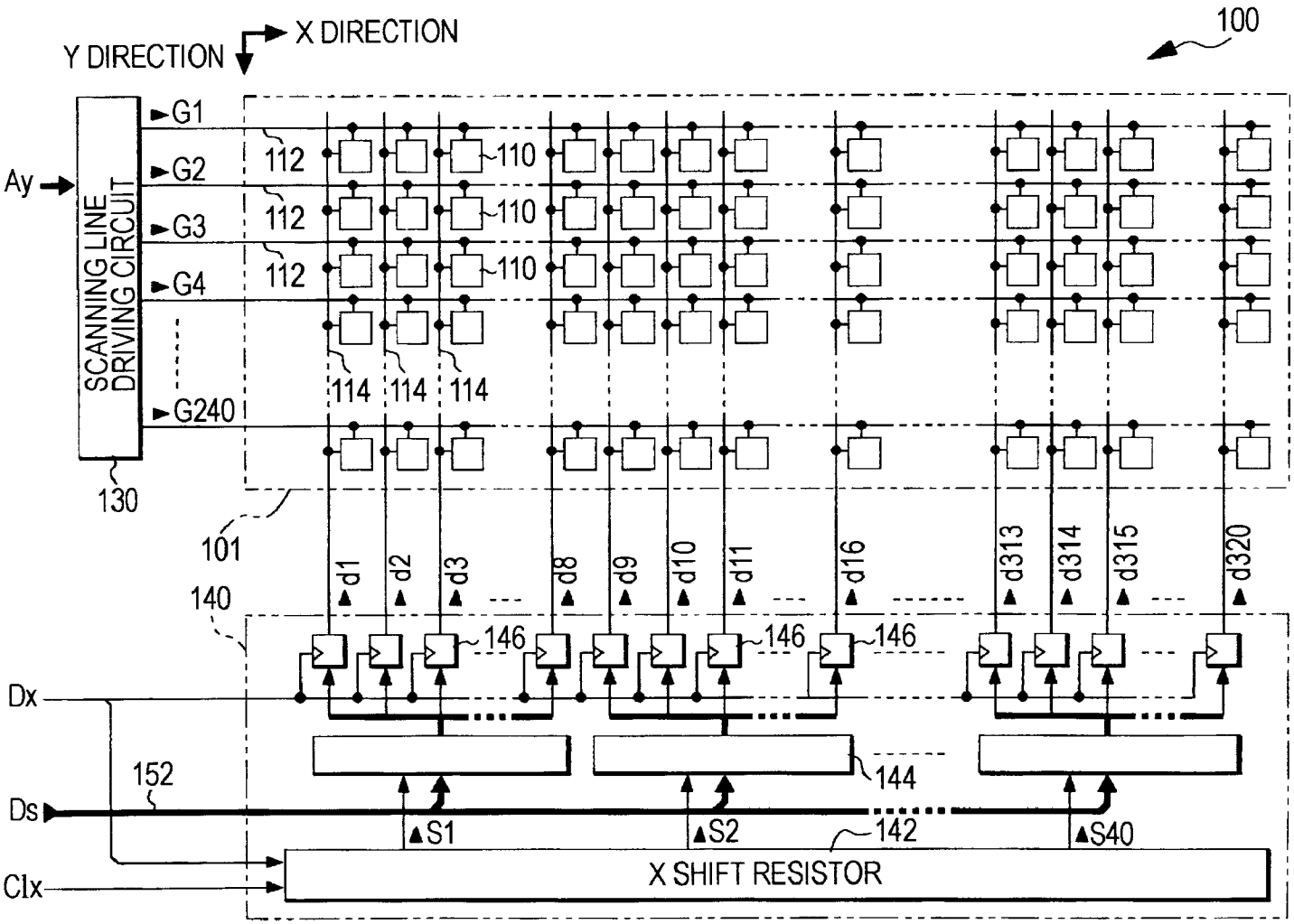
FIG. 2 is a diagram illustrating the configuration of a display panel in the electro-optic device.

As shown in FIG. 2, in a display area 101 of the display panel 100, scanning lines 112 in first, second, third, . . . , and two hundred fortieth rows extend in an X direction (a horizontal direction in the drawing) and data lines 114 in first, second, third, . . . , and three hundred twentieth columns extend in a Y direction (a vertical direction in the drawing) so as to be electrically insulated from the scanning lines 112.

Pixels 110 are arranged to correspond to intersections between the scanning lines 112 in the 240 rows and the data lines 114 in the 320 columns. In this embodiment, the pixels 110 are arranged in a matrix shape having vertical 240 rows× horizontal 320 columns in the display area 101.

In this embodiment the data lines 114 are blocked every 8 columns. Specifically, the data lines 114 are blocked every 8 columns in first to eighth columns, in ninth to sixteenth columns, seventeenth to twenty fourth columns, . . . , and three hundred thirteenth to three hundred twentieth columns. Accordingly, first, second, third, . . . , and fortieth blocks are sequentially formed in block unit.

A scanning line driving circuit 130 supplying respective scanning signals to the scanning lines 112 and a data line driving circuit 140 supplying data bits as data signals to the data lines 114 are arranged in the vicinity of the display area 101.

The scanning line driving circuit 130 is an address decoder which sets the scanning signals to be supplied to the scanning lines designated by address signals Ay to an H level corresponding to selection voltage and sets the scanning signals to be supplied to the other scanning lines to an L level corresponding to non-selection voltage.

Assuming that the scanning signals to be supplied to the scanning lines 112 in first, second, third, . . . , and two hundred fortieth rows are G1, G2, G3, . . . , and G240, respectively, and a scanning signal to be supplied to an i-th scanning line 112 where i is an integer number in the range of 1 to 240 is Gi, the scanning line driving circuit 130 sets only the scanning signal Gi to the H level and sets the other scanning signals to the L level, when the i-th scanning line is designated by the address signal Ay.

On the other hand, the respective data bits are supplied to the data lines 114 in first to three hundred twentieth columns by the data line driving circuit 140. Here, the data bits to be supplied to the data lines 114 in first, second, third, . . . , and three hundred twentieth columns, respectively, are assumed to be d1, d2, d3, . . . , and d320. The data line driving circuit 140 is described below.

Figure 3:
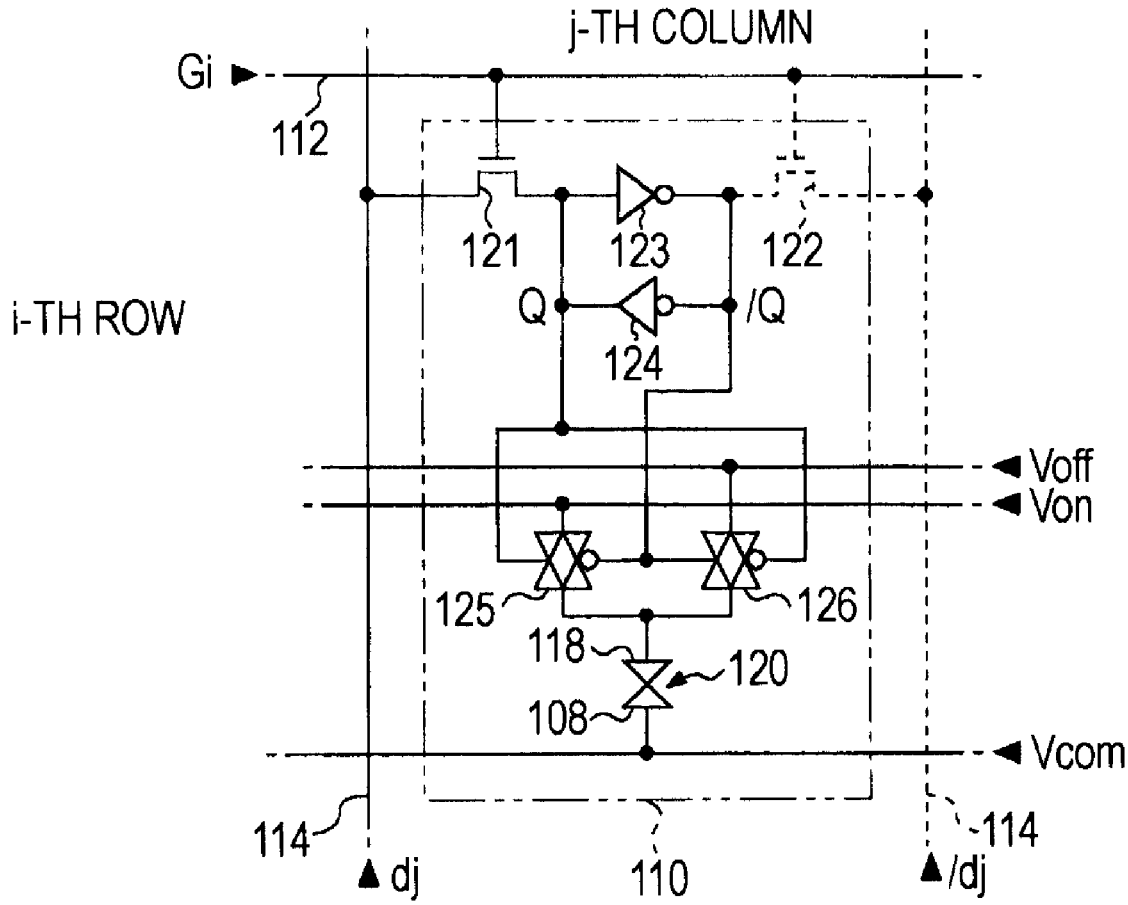
FIG. 3 is a diagram illustrating an example of a pixel in the display panel.

FIG. 3 is a diagram illustrating an example of a pixel 110 in the display panel 100. Since the pixels 110 have the same configuration, a general pixel 110 in an i-th row and a j-th column will be described.

j is a sign generally representing a column of the line in which the pixel 110 is arranged and an integer number in the range of 1 to 320.

As shown in FIG. 3, the pixel 110 includes a liquid crystal element 120, an n-channel type transistor 121, NOT circuit 123 and 124, and analog switches (transmission gates) 125 and 126. In the pixel 110 in the i-th row and the j-th column, a gate electrode of the transistor 121 is connected to the i-th scanning line 112, a source electrode is connected to the j-th data line 114, and a drain electrode is connected to an input terminal of the NOT circuit 123. An output terminal of the NOT circuit 123 is connected to an input terminal of the NOT circuit 124 and an output terminal of the NOT circuit 124 is connected to the input terminal of the NOT circuit 123.

Here, it is assumed that the input terminal of the NOT circuit 123 and the output terminal of the NOT circuit 124 are connection points Q and the output terminal of the NOT circuit 123 and the input terminal of the NOT circuit 124 are connection point /Q.

When the i-th scanning line 112 is set to the H level and thus the transistor 121 is turned on, a data bit dj supplied to the j-th data line 114 is stored at the connection point Q and an inversion bit of the data bit dj is stored at the connection point /Q in the pixel 110 in the i-th row and the j-th column. The stored data bit is stored as static, even when the i-th scanning line 112 is set to the L level.

The liquid crystal element 120 is interposed between the pixel electrode 118 of every pixel and a common electrode 108 which is common in every pixel and to which a signal Vcom is applied. The liquid crystal element 120 has a configuration in which transmissivity varies in accordance with a holding voltage. In this embodiment, the voltage held in the liquid crystal element 120 is ON and OFF binary voltages described below. Accordingly, when the liquid crystal element 120 is in a normally white mode, a bright state (OFF state) is maintained at the time of holding the OFF voltage and a dark state (ON state) is maintained at the time of holding the ON voltage.

When the bits in the connection points Q are "0" corresponding to the L level (when the bits in the connection points /Q are "1"), the analog switches 125 and 126 are turned ON and OFF, respectively, and a signal Voff is applied to the pixel electrode 118. On the other hand, when the bits in the connection points Q are "1" corresponding to the H level (when the bits in the connection points /Q are "0"), the analog switches 125 and 126 are turned ON and OFF, respectively, and a signal Von is applied to the pixel electrode 118.

Actually, as shown in a dashed line in FIG. 3, it is preferable that an inversion data line 114' supplying the inversion bit /dj of the data bit dj in each column and is provided in each column and the transistor 122 is provided in each pixel. However, in the invention, since the pixels 110 are turned ON or OFF and the inner configuration thereof is not important, more description is omitted.

Figure 4:
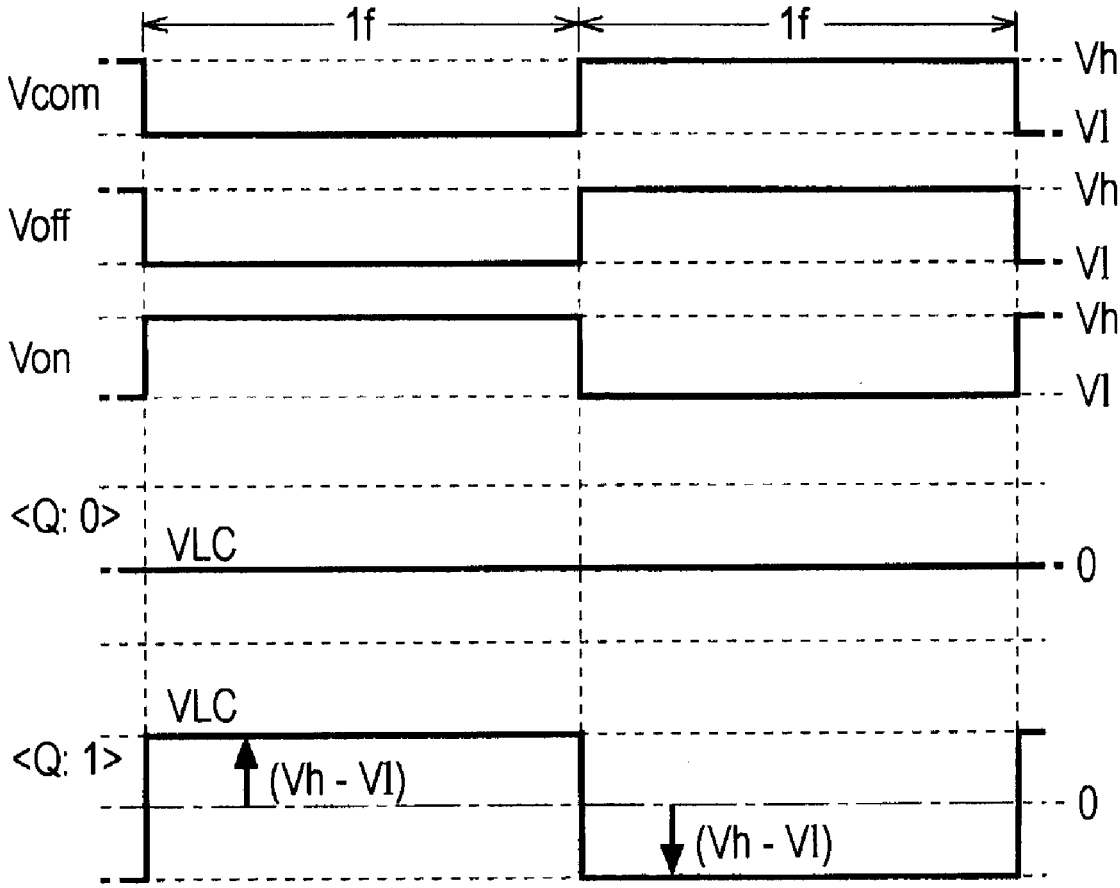
FIG. 4 is a diagram illustrating an operation of the pixel.

The signals Vcom, Von, and Voff are supplied as voltages shown in FIG. 4 by a timing control circuit 20 in FIG. 1. Specifically, as shown in FIG. 4, the voltage of the signal Vcom is varied into Vh and Vl alternatively in every one field (1f). In addition, the signal Von takes a voltage reverse to the signal Vcom and signal Voff takes the same voltage as the signal Vcom.

Accordingly, when the bit in the connection points Q is "0", the same voltage as that of the common electrode 108 is applied to the pixel electrode 118. Therefore, a holding voltage $V_{LC}$ of the liquid crystal element 120 becomes zero corresponding to the OFF voltage. On the other hand, when the bit in the connection points Q is "1", a voltage reverse to that of the common electrode 108 is applied to the pixel electrode 118. Therefore, the holding voltage $V_{LC}$ of the liquid crystal element 120 becomes (Vh-Vl) corresponding to the ON voltage.

In a case where the bit in the connection points Q is "1", the pixel electrode 118 becomes higher (positive polarity) than the common electrode 108 in potential when the signal Vcom is in the voltage Vl. In addition, the pixel electrode 118 becomes lower (negative polarity) than the common electrode 108 in potential when the signal Vcom is in the voltage Vh. Therefore, the liquid crystal element 120 is driven in an alternating current in every one field, thereby preventing deterioration in liquid crystal.

FIG. 4 shows how the holding voltage $V_{LC}$ of the liquid crystal element 120 varies when the bit stored in the connection points Q is constant as "0" or "1". Actually, the bit stored in the connection points Q is rewritten in every sub-field into which one field is divided, as described below.

The configuration of the pixel 110 shown in FIG. 3 is an exemplary configuration when the liquid crystal element 120 is used as a display element. When the pixel 110 is a display element acquiring an ON state and an OFF state, various types may be used, as described below.

Next, in order to express the gray scales using the liquid crystal element 120 which takes only two states, that is, the ON state and the OFF state, it is necessary to control a ratio of a period occupied by the ON state (the OFF state), by dividing one field (1f) as a unit period into plural sub-fields and allowing the liquid crystal element 120 to be turned ON or OFF in every sub-field.

Here, one field refers to a unit period which is necessary to express the gray scales of all the pixels 110 in the display area 101. The one field is the same as a frame in a non-interlacing method and is constant as 16.7 ms (one period of a 60 Hz field frequency).

Next, the sub-field in the electro-optic device will be described according to the embodiment.

In this embodiment, one field is equally divided into plural slots. The slots are assigned to the sub-fields belonging to the first and second groups. Specifically, the period length of each of the sub-fields belonging to the first group is set as the same period length as that of the slot. In addition, the period length of each of the sub-fields belonging to the second group is set as a period length which is the same one another and corresponds to predetermined times of the period length of each of the sub-fields belonging to the first group.

When gray scales are expressed by use of the sub-fields set in this manner, an ON/OFF state in each of the sub-fields is regulated in every gray scale so that a period in which brightness continues becomes longer in one field from a dark gray scale level to a bright gray scale level.

Figure 5:
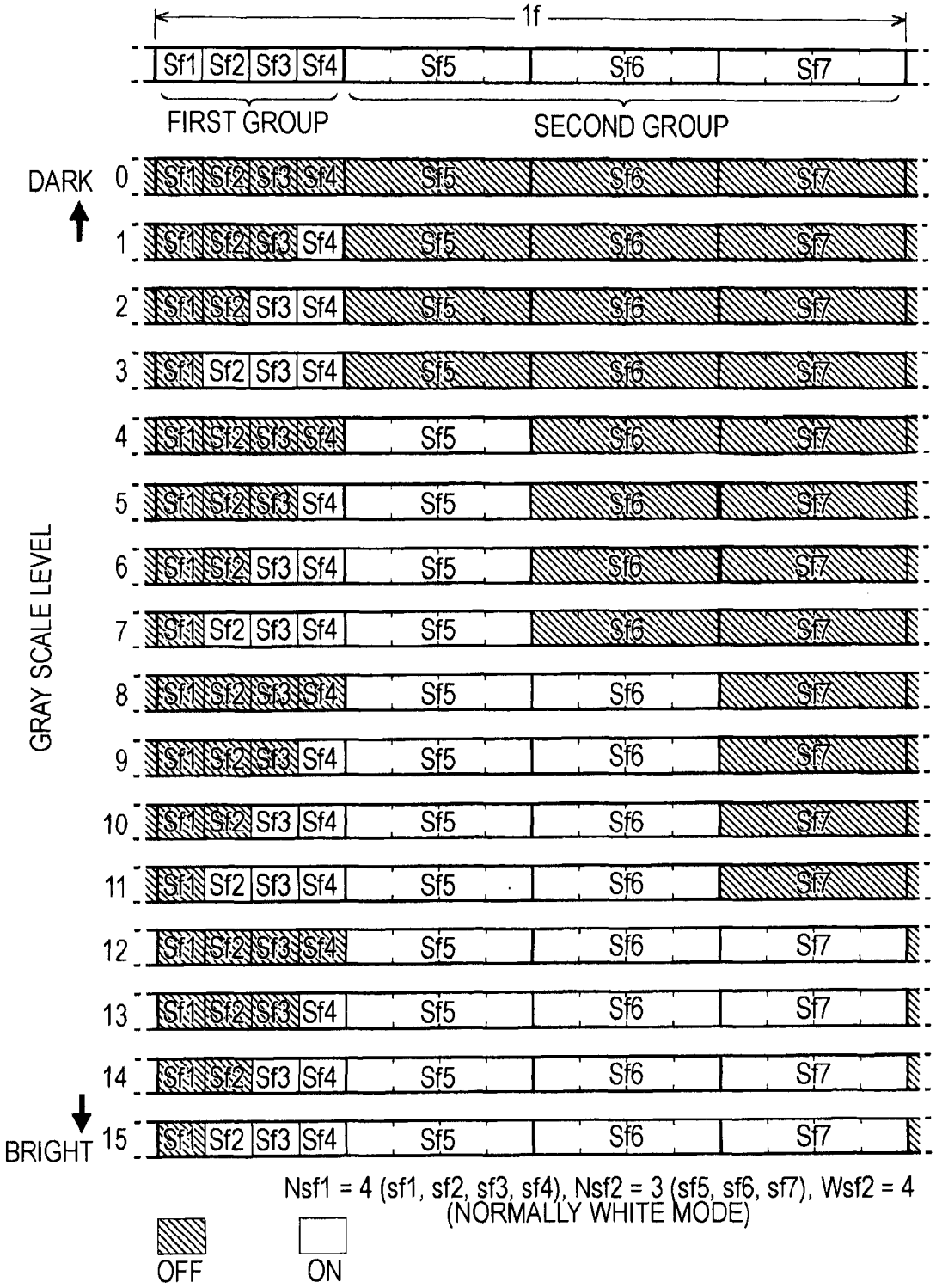
FIG. 5 is a diagram illustrating the configuration of fields in the electro-optic device.

FIG. 5 is a diagram illustrating an example of the assigned sub-fields.

In the example shown in FIG. 5, one field is equally divided into sixteen slots and the sub-field is assigned in slot unit. Specifically, the sub-fields are classified into first and second groups. Sub-fields sf1 to sf4 belonging to the first group are set to have the same period length as that of the slot. Sub-fields sf5 to sf7 belonging to the second group are set to have the same period length and correspond to four times of each of the sub-fields sf1 to sf4 belonging to the first group.

In the example shown in FIG. 5, the one field is arranged in order of sub-fields sf1, sf2, sf3, sf4, sf5, sf6, and sf7 in a temporal sequence.

In this embodiment, since the liquid crystal element 120 is in the normally white mode in which the gray scale level is dark in the ON state and the gray scale level is bright in the OFF state, the ON state and the OFF state are designated in every gray scale level in each of the sub-fields.

The sub-field sf1 is forcedly set to the ON state or the OFF state, irrespective of the gray scale level. That is because restraint on a liquid crystal characteristic (low response) or a pseudo-contour is taken into consideration. In particular, in the example shown in FIG. 5, since "a blur impression" at the time of displaying a moving picture is taken into consideration, the gray scale level is dark in the ON state in the normally white mode in the sub-field sf1. In the normally black mode, since the gray scale level is dark in the OFF state, the sub-field sf1 is forcedly set to the OFF state, irrespective of the gray scale level.

In the example shown in FIG. 5, the bright gray scale level is designated by setting the boundary between the first and second groups, that is, the boundary between the sub-fields sf4 and sf5 as a reference position. Therefore, the sub-fields are designated so that all the sub-fields in the OFF state continue in a direction in which the sub-field in the OFF state is in the most distance from the corresponding boundary. Accordingly, since the transition number of times from ON to OFF per one field and the transition number of times from OFF to ON per one field are each one time in each gray scale level other than a gray scale level "0", an influence of a response characteristic of liquid crystal on the gray scale level can be made equal in each gray scale level.

In the example shown in FIG. 5, in a different point of view, the dark gray scale level is designated by setting the boundary of one field to the reference position. Therefore, the sub-fields are designated so that all the sub-fields in the ON state continue in a direction in which the sub-field in the ON state is in the most distance from the corresponding boundary.

Accordingly, the reference position used when the sub-fields in the ON state or the OFF state continue is not limited to the boundary between the first and the second groups in the same field. However, the reference position may be set as a boundary between the second group in a temporally front field and the first group in a temporally rear field.

In the display panel 100, the sub-fields shown in FIG. 5 are applied to be driven.

Again in FIG. 1, the display control circuit 10 includes the timing control circuit 20, the field memory 30, and an LUT (Look-up Table) 40, and a blocking circuit 50.

The timing control circuit 20 generates a control signal Ctr to control drive of the scanning line drive circuit 130 and drive of the data line driving circuit 140 in the display panel 100. In addition, the timing control circuit 20 also controls the field memory 30 and the LUT 40 so as to match with the drive control.

The control signal Ctr includes signals Vcom, Von, and Voff which are common in all the pixels 110 of the display panel 100, in addition to a pulse signal Dx and a clock signal Clx described below and the address signal Ay.

The field memory 30 has storage areas corresponding to pixel arrangement of the vertical 240 rows×horizontal 320 columns. Display data Da each designating the gray scale levels of the pixels 110 are stored in the storage areas.

The display data Da are supplied from an upper level circuit (not shown) and written to the storage areas of the field memory 30. In addition, the display data Da corresponding to one row of the pixels located in a scanning line selected previously by one line than a scanning line designated by the address signal Ay are read in a sequence from first to three hundred twentieth columns from the field memory 30 by the timing control circuit 20.

The LUT 40 converts the display data Da read from the field memory 30 into data bits Db for designating the pixels to the ON state or the OFF state in correspondence with the sub-fields sf1 to sf7 notified by a number Sb. Here, designation of the gray scale level and the ON state or the OFF state of the pixels in the sub-fields sf1 to sf7 is shown in FIG. 5.

Assuming that each of the pixels is designated to the OFF state when the data bit is "0" and each of the pixels is designated to the ON state when the data bit is "1", the display data Da in which the gray scale level is "6" are converted into "1", "1", "0", "0", "0", "1", and "1" in the sub-fields sf1 to sf7, respectively.

The blocking circuit 50 collects the data bits Db converted by the LUT 40 in a unit of every eight bits in every block of the data lines in accordance with the control of the timing control circuit 20, and output the collected data bits Db as data Ds to signal lines 152.

In this way, in one sub-field, the display data Da corresponding to one row of the pixels read from the field memory 30 are output to the signal lines 152 as the data Ds made by collecting the data bits Db regulating the ON state and the OFF state in the corresponding sub-fields in the blocks in the first to eighth columns, the ninth to sixteenth columns, the seventeenth to twenty fourth columns, . . . , and the three hundred thirteenth to three hundred twentieth columns.

Figure 8:
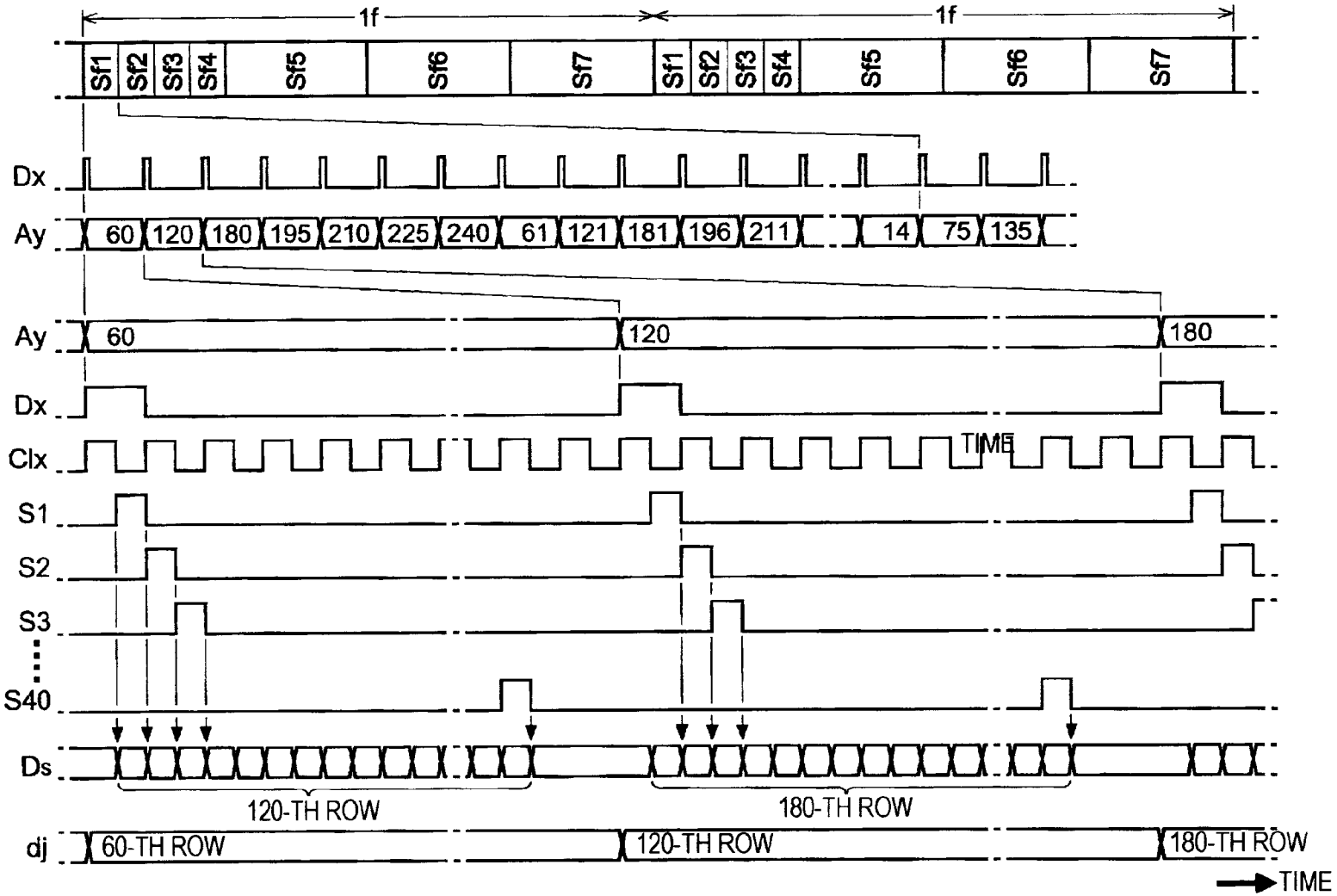
FIG. 8 is a diagram illustrating an operation in the electro-optic device.

In FIG. 2, the data line driving circuit 140 includes an X shift resistor 142, latch circuits 144 each provided in each block, and latch circuits 146 each provided in each data line. As shown in FIG. 8, the X shift resistor 142 sequentially shifts the pulse signals Dx to be supplied at the time of starting a period in which one scanning line is selected by the address signal Ay whenever a logic level of the clock signal Clx varies. In addition, the X shift resistor 142 narrows the width of the shifted pulse signals to the half cycle of the clock signal Clx to output the narrowed pulse signals as sampling signals S1, S2, S3, . . . , and S40 in correspondence with the respective blocks.

The latch circuit 144 provided in each block latches the data Ds supplied to the signal lines 152 at timing in which a sampling signal becomes an H level and continues to hold the data Ds later, even when the sampling signal becomes an L level.

The timing control circuit 20 controls the X shift resistor 142 so as to synchronize with the data Ds to be supplied to the signal lines 152. Specifically, the timing control circuit 20 controls the X shift resistor 142 by supplying the pulse signals Dx and the clock signals Clx so that the sampling signals S1, S2, S3, . . . , S40 sequentially become the H level, when the data Ds collected in the blocks in the first to eighth columns, the ninth to sixteenth columns, the seventeenth to twenty fourth columns, . . . , and the three hundred thirteenth to three hundred twentieth columns are supplied to the signal lines 152.

With such a configuration, the latch circuits 144 corresponding to the first, second, third, . . . , fortieth blocks latch the data Ds collected in the blocks in the first to eighth columns, the ninth to sixteenth columns, the seventeenth to twenty fourth columns, . . . , and the three hundred thirteenth to three hundred twentieth columns.

The latch circuit 146 provided in each data line latches data bits of the column corresponding to the latch circuit 146 in the data Ds latched by the latch circuit 144 at timing in which the pulse signals Dx become the H level, and continues to hold the data bits and supply them to the data lines 114.

The data Ds (the data Ds collected in the blocks in the first to eighth columns, the ninth to sixteenth columns, the seventeenth to twenty fourth columns, . . . , and the three hundred thirteenth to three hundred twentieth columns) supplied to the signal lines 152 are latched in accordance with the sampling signals S1, S2, S3, . . . , S40 by the latch circuits 144, and again latched in accordance with the pulse signals Dx by the latch circuits 146, and then supplied to the data lines 114. Accordingly, when the scanning line of one row is selected by the scanning line driving circuit 130, the timing control circuit 20 controls the data Ds corresponding to one row of the pixels located in the scanning line of the one row to be supplied to the signal lines 152 before the selection period. When the scanning line of the one row is selected by this control, the data bits regulated by the gray scale level and the sub-field of the pixels are supplied to the pixels located in the scanning line of the one line through the data lines.

In a known driving method of selecting the scanning lines one by one in order of first row, second row, third row, . . . , the selection of all the scanning line needs to be completed within a period of the shortest sub-field. In order to solve this problem, this embodiment uses a method of performing scanning while interlacing the number of scanning lines by the number of rows according to a ratio (weight) of period lengths obtained when the sub-fields constituting one field are arranged temporally in descending order.

Figure 6:
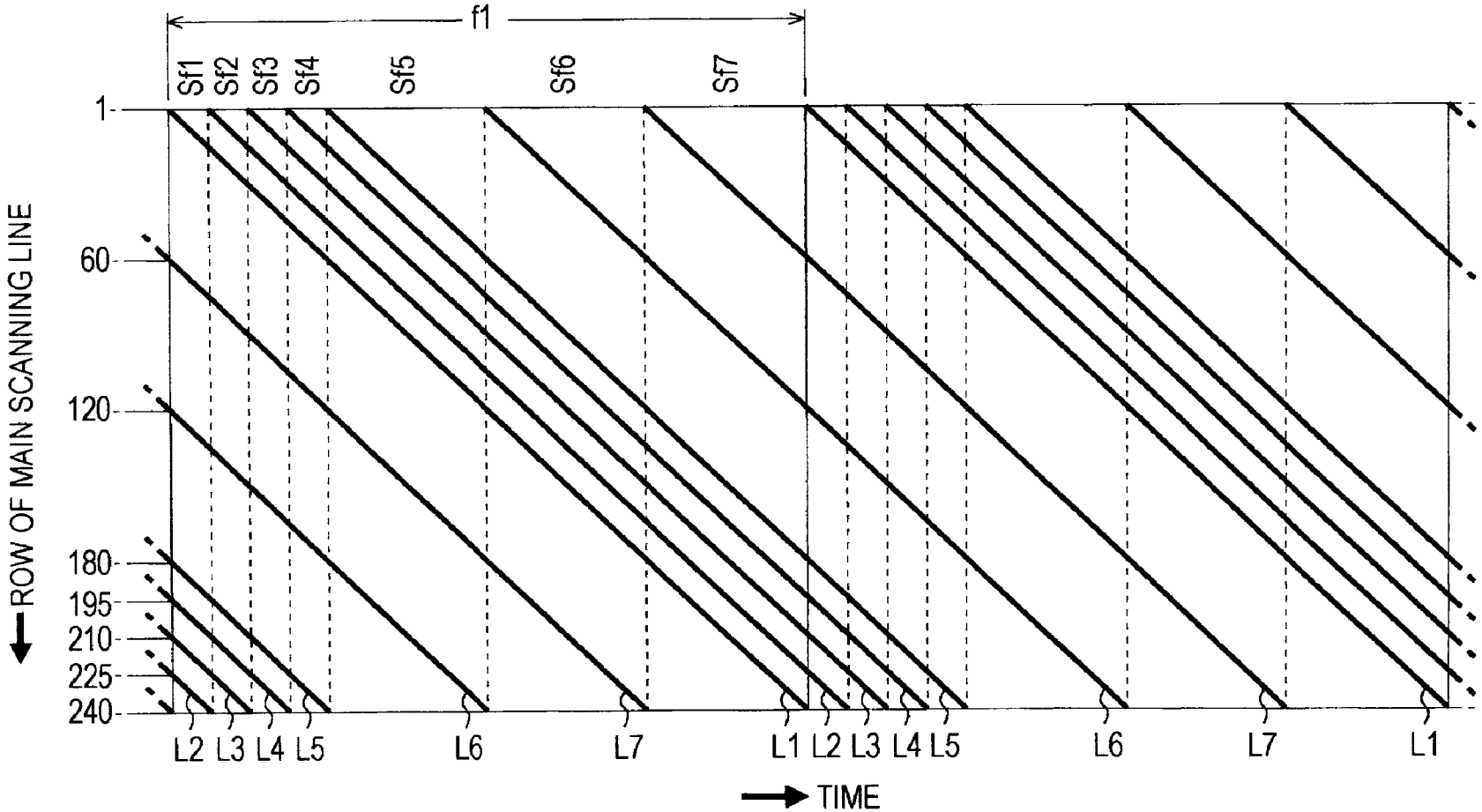
FIG. 6 is a diagram illustrating a change in selection of scanning lines in the electro-optic device.

For example, in the case of the display panel 100 (see FIG. 2) having "240" scanning lines, when "240" as the number of scanning lines are divided into 4:4:4:1:1:1 as the ratio of the period lengths of the sub-fields sf7, sf6, sf5, sf4, sf3, sf2, and sf1 which are arranged temporally in descending order, an interlaced row number of 60, 60, 60, 15, 15, 15, and 15 can be obtained. Therefore, the interlaced scanning is performed on the scanning lines of the display panel 100 sequentially by 60, 60, 60, 15, 15, 15, and 15 rows, as shown in FIGS. 6 and 7.

Specifically, assuming that the reference position of the scanning lines selected in the initial sub-field sf1 of one field is a sixtieth row, the interlaced scanning is performed on 60th, 120th, 180th, 195th, 210th, 225th, and 240th rows. Next, the reference position is moved by one row and the interlaced scanning is performed on 61st, 121st, 181st, 196th, 211th, 226th, and 1st rows. Likewise, the reference position is moved to 62nd, 63rd, . . . , 240th, 1st, 2nd, . . . , 59th rows by one row and the interlaced scanning is performed by use of each reference position in one field.

At this time, when the scanning line (L7) associated with the reference position is selected, the data bit for the sub-field sf7 is written. In addition, when the scanning line (L6) interlaced by 60 rows from L7 is selected, the data bit for the sub-field sf6 is written. Likewise, when the scanning line (L5) interlaced by 60 rows from L6 is selected, the data bit for the sub-field sf5 is written. When the scanning line (L4) interlaced by 15 rows from L5 is selected, the data bit for the sub-field sf4 is written. When the scanning line (L3) interlaced by 15 rows from L4 is selected, the data bit for the sub-field sf3 is written. When the scanning line (L2) interlaced by 15 rows from L3 is selected, the data bit for the sub-field sf2 is written. When the scanning line (L1) interlaced by 15 rows from L2 is selected, the data bit for the sub-field sf1 is written.

The pixels to which the data bits are input in this manner maintain the ON State or the OFF state according to the written data bits, respectively, until the next data bits are written. Accordingly, in this embodiment, the ON state (the OFF state) is maintained during only the period according to the gray scale level in one field. Therefore, the gray scales can be expressed, assuming that one field is a unit period.

When the number of scanning lines is "240", in the known driving method, the "240" scanning lines have to be selected within the period corresponding to the shortest sub-field. However, in the interlaced scanning according to this embodiment, the number of scanning lines selected within the period corresponding to the shortest sub-field is "105" (=7×15). Therefore, since the number of scanning lines selected within the period corresponding to the shortest sub-field is reduced by the half or less, driving is possible with low frequency.

FIG. 6 is a diagram illustrating a temporal change in the scanning lines selected when the scanning lines in the first to two hundred fortieth rows are on a vertical axis and time is on a horizontal axis. Assuming that the selection of the scanning lines is indicated by • (a dot having a black circular shape), the temporal change of the scanning lines are indicated by continuous dots of •, since the interlaced scanning is performed on the scanning lines, as describe above. However, for simple indication, the continuous dots are indicated by a full line in the lower right direction in the drawing.

FIG. 7 is a table showing the row numbers of the scanning lines selected by the scanning line driving circuit 130 in each sub-field. In other words, FIG. 7 shows the sequence of the scanning lines designated by the address signals Ay.

FIG. 8 is an explanatory diagram illustrating operations of the data line driving circuit 140. For example, when a 120th scanning line is selected, the data Ds supplied before the selection period and corresponding to one row of the pixels in the 120th row are latched in accordance with the sampling signals S1 to S40 by the latch circuit 144, latched in accordance with the pulse signals Dx by the latch circuit 146, and then supplied as the data bits dj to the data lines 114.

The above description has been made, assuming that the number of scanning lines is "240". Next, the number of scanning lines is described in a general manner.

In the interlaced scanning described above, the number of the scanning lines is interlaced by the number of rows according to the ratio of the period lengths obtained when the sub-fields constituting one field are arranged in descending order. Therefore, the number of scanning lines selected when all the scanning lines are subjected to the interlaced scanning is equal to the number of sub-fields constituting one field.

In the example of the interlaced scanning described above, all the selected scanning lines are subjected to the interlaced scanning in order of L7→L6→L5→L4→L3→L2→L1→(L7). Therefore, the number of the scanning lines selected when all the scanning lines subjected to the interlaced scanning is equal to "7" which is equal to the number of sub-fields constituting one field.

Assuming that the smallest value among the numbers of interlaced scanning lines obtained when all the scanning lines are subjected to the interlaced scanning is a reference number of interlaced scanning lines, the number of reference interlaced scanning lines can be expressed by a value obtained by multiplying the weight of the period length of the shortest sub-field among the sub-fields by the number of all scanning lines. In this embodiment, one field is equally divided into plural slots and each of the sub-fields belonging to the first group is assigned to the slot as minimum unit. Assuming that the number (division number) of slots in one field is Ndiv, a weight of the sub-fields belonging to the first group with respect to one field is 1/ndiv. Accordingly, assuming that the number of scanning lines is Rreal, the number Ys of reference interlaced scanning lines can be expressed as follows:

$$Ys=(Rreal/Ndiv) \tag{1}$$

Actually, the number Ys of reference interlaced scanning lines can take only an integer number. Therefore, when a value of the right side of Expression (1) has a decimal, an integer number obtained by rounding up the value to the left of the decimal point is determined as the number Ys of reference interlaced scanning lines.

Here, assuming that the number of scanning lines with reference to the number Ys of reference interlaced scanning lines is a number Rvir of virtual scanning lines, the number Rvir of virtual scanning lines can be expressed as follows:

$$Rvir=Ndiv\times Ys \tag{2}$$

where a relation of Rvir≧Rreal is satisfied.

Since "240" as the number Rreal of scanning lines in the example described above can be divided by "16" as the division number Ndiv of one field, the number Ys of reference interlaced scanning lines is equal to "15" and the number Rvir of virtual scanning lines is equal to "240" as the number Rreal of scanning lines. Assuming that the number of scanning lines is "241", the number of scanning lines cannot be divided by "16" as the division number Ndiv and thus the number Ys of reference interlaced scanning lines is equal to "16". Accordingly, when 241 rows are displayed, the number Rvir of virtual scanning lines is equal to "256" in the interlaced scanning and thus is not equal to the number Rreal of scanning lines.

Next, in this embodiment, assuming that a weight Wsf1 of the period lengths of the sub-fields belonging to the first group is "1", an integer value obtained by rounding off a square root of the division number Ndiv to the left of the decimal point is determined as a weight Wsf2 of the period lengths of the sub-fields belonging to the second group (Condition 1).

On the other hand, assuming that the number of sub-fields belonging to the first group is Nsf1 and the number of sub-fields belonging to the second group is Nsf2, the number Nsf2 of sub-fields is determined as the following expression:

$$Nsf2-(Ndiv/Wsf2)-1 \tag{3}$$

Actually, the number Nsf2 of sub-fields can take only an integer number. Therefore, when a value of the right side of Expression (3) has a decimal, an integer number obtained by rounding up the value to the left of the decimal point is determined as the number Nsf2 of sub-fields. Accordingly, the number Nsf1 of sub-fields is determined by the following expression:

$$Nsf1=N\text{div}-Wsf2\times Nsf2 \quad (4)$$

The number Nsf of sub-fields in one field satisfies the following expression:

$$Nsf=Nsf1+Nsf2 \quad (5)$$

Here, assuming that field frequency is f (=60 Hz), selection time Trow of the scanning lines per one time is expressed as the following expression:

$$T\text{row}=1/(f\times Nsf\times R\text{vir}) \quad (6)$$

In the example described above, the number Nsf of sub-fields in one field is "7" and the number Rreal of scanning lines is "240". When the number Rreal of scanning lines is "240", the number Rvir of virtual scanning lines is also "240". Therefore, in the example described above, the selection time Trow is equal to 9.92 μs.

Next, assuming that the number Rreal of scanning lines is "1080", for example, in order to display a high-quality image, it will be examined which number one field is divided and how the number Nsf1 of sub-fields belonging to the first group, the number Nsf2 of sub-fields belonging to the second group, the weight Wsf2 are set.

Figure 10:
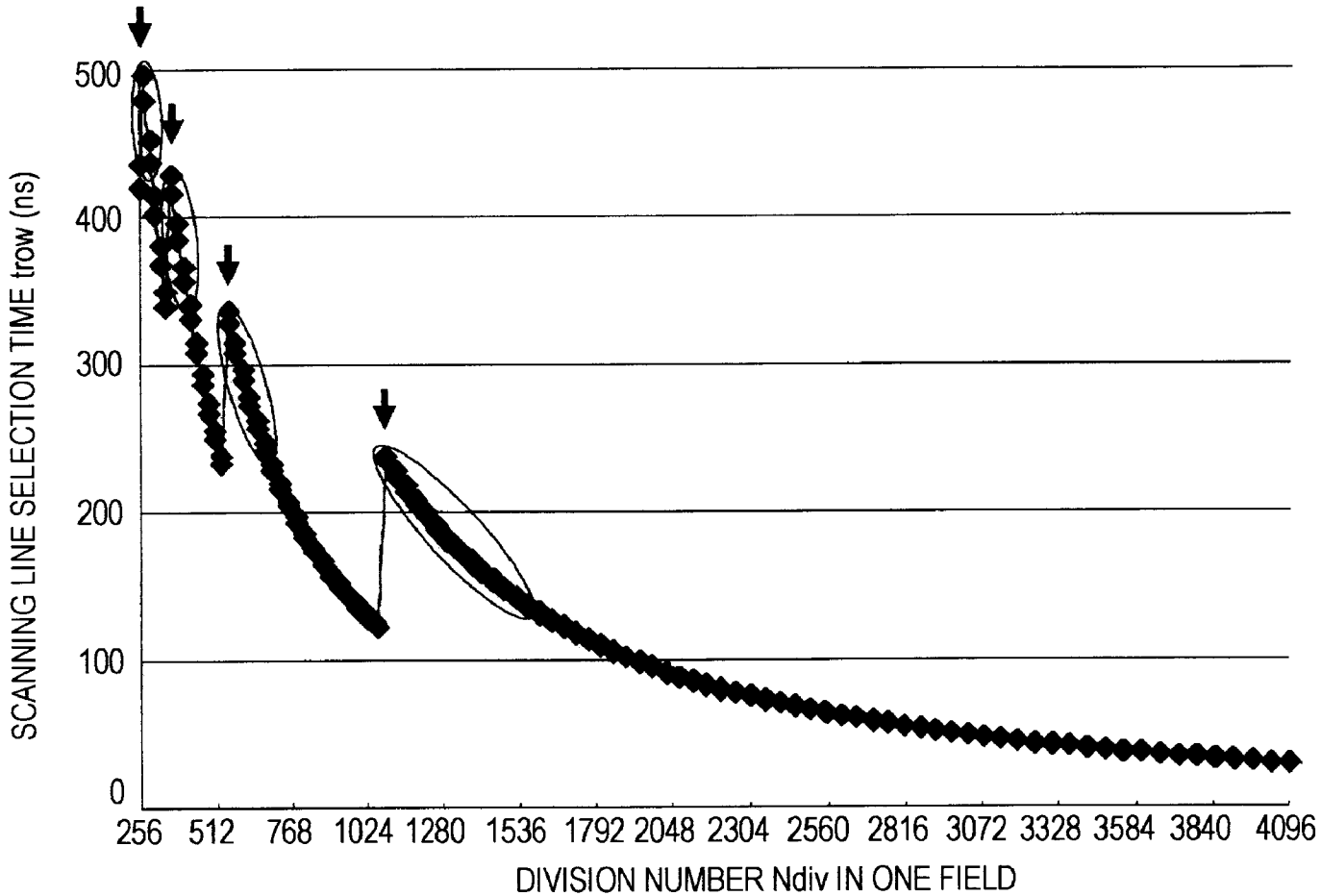
FIG. 10 is a diagram illustrating the relation between the division number of a field and selection time of the scanning lines.

FIG. 9 is a diagram illustrating values of the number Ys of reference interlaced scanning lines for the division number Ndiv of one field, the selection time Trow of the scanning lines, and the like. FIG. 10 is a diagram illustrating a characteristic of the selection time Trow of the scanning line for the division number Ndiv.

Here, since it is assumed that the number Rreal of scanning lines is "1080", combinations in which the number Rreal of scanning lines and the number Rvir of virtual scanning lines are smaller than "1080" are excluded.

In the drawing, the division number Ndiv increases discontinuously. The reason is as follows. That is, the division number Ndiv are not allowed to take an integer number freely, since the division number Ndiv is restricted by Condition 1, Expression (3), and Expression (4).

The combinations in which the number Rreal of scanning lines and the number Rvir of virtual scanning lines are smaller than "1080" are excluded and the division number Ndiv satisfying Condition 1, Expression (3), and Expression (4) is selected.

When the division number Ndiv is selected in this manner, it was known that ranges ensuring that the selection time Trow of the scanning lines is longer immediately after the number Ys of reference interlaced scanning lines is changed (points indicated by → in FIG. 9 and ↓ in FIG. 10) exist as shown FIG. 9. For example, a case where the division number Ndiv is set to "256" and a case where the division number Ndiv is set to "271" are compared to each other.

Intuitively, it can be considered that the selection time Trow of the scanning lines can be ensured longer in the case where the division number Ndiv is set to "256" than in the division number Ndiv is set to "271". However, actually, when the calculation is made according to Condition 1 and Expressions (1) to (6), the selection time Trow in case where the division number Ndiv is set to "256" is 420.03 ns. The selection time Trow in case the division number Ndiv is set to "271" is 495.97 ns. Accordingly, it can be known that the selection time Trow can be ensured longer in the case where the division number Ndiv is "271".

An advantage can be obtained in that the number of expressible gray scales is increased by the larger division number.

In FIG. 10, when the division number Ndiv in a left area of each point indicated by ↓ and the division number Ndiv of a right area indicated by a full line O are compared to each other, an advantage can be obtained actually when values of the right area, which it is intuitively considered that a disadvantage occurs due to the large division number Ndiv, are used. That is because the selection time Trow can be ensured longer and the number of expressible gray scales can be increased.

When one division number Ndiv included in the right area is determined, the numbers Nsf1 and Nsf2 of sub-fields, the weight Wsf2, and the number Ys of reference interlaced scanning lines are necessarily determined. Therefore, how to perform the interlaced scanning is naturally determined.

When a relation of the number Rvir of virtual scanning lines>the number Rreal of scanning lines is satisfied, scanning lines contributing to display are assigned to some of the virtual scanning lines, and the other scanning lines excluded in the assignment may be handed as dummy scanning lines.

Assuming that the weight Wsf2 of the sub-fields belonging to the second group is "16", the number Nsf1 of sub-fields belonging to the first group is "14", the number Nsf2 of sub-fields belonging to the second group is "16", and thus the division number Ndiv is "270", the number Rvir of virtual scanning lines becomes "1080". Therefore, the selection time Trow of 514.40 ns can be ensured.

However, if a relation of Nsf1≧Wsf2−1 . . . (7) is not satisfied, a change ratio of a period in which the ON state is formed for the gray scale level is not uniform (where gray scales which cannot be expressed for "270" as the division number exist. For example, the ON/OFF state corresponding to "15" in one field cannot become the period length).

In this examination, the number Rreal of scanning lines is "1080", but may be any value. When the number Rreal of scanning lines is set to a value other than "1080", combinations in which the number Rreal of scanning lines and the number Rvir of virtual scanning lines are smaller than a set value are excluded and the division number Ndiv satisfying Condition 1, Expression (3), and Expression (4) is selected. Then, noticeable points are that the number Ys of reference interlaced scanning lines for the selected division number Ndiv is changed and the division number Ndiv is large.

Figure 11:
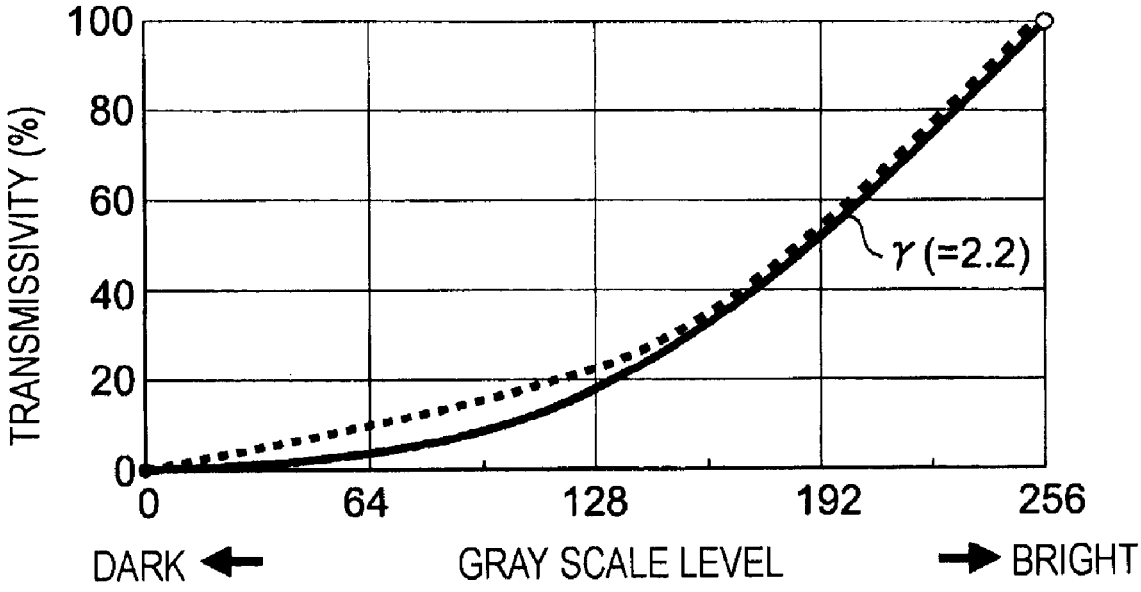
FIG. 11 is a diagram illustrating a γ characteristic.

The spectral sensitivity of the eyes of a person has a characteristic of a curved shape in which gamma coefficient is "2.2" (in a case of 256 gray scales), as indicated by a full line in FIG. 11. Therefore, when viewed with a display device, gray scales more natural to a person can be realized in a characteristic in which a variation is slight so that pixel transmissivity approaches a gamma characteristic, as the gray scale level is darker. Next, a method of allowing the characteristic of pixel transmissivity in the display panel 100 to approach the gamma characteristic will be examined.

In FIG. 11, the transmissivity is normalized assuming that a value of the transmissivity obtained when a pulse width is "1088" is 100% and a value of the transmissivity obtained when the pulse width is "0" is 0%.

A case where the number of scanning lines is "1080" and the division number is "1088" in FIG. 9 will be described as an example. In the example, the weight Wsf1 of the period lengths of the sub-fields belonging to the first group is "1", the number Nsf1 of sub-fields belonging to the first group is "32", the weight Wsf2 of the period lengths of the sub-fields belonging to the second group is "33", and the number Nsf2 of sub-fields belonging to the second group is "32".

Figure 12:
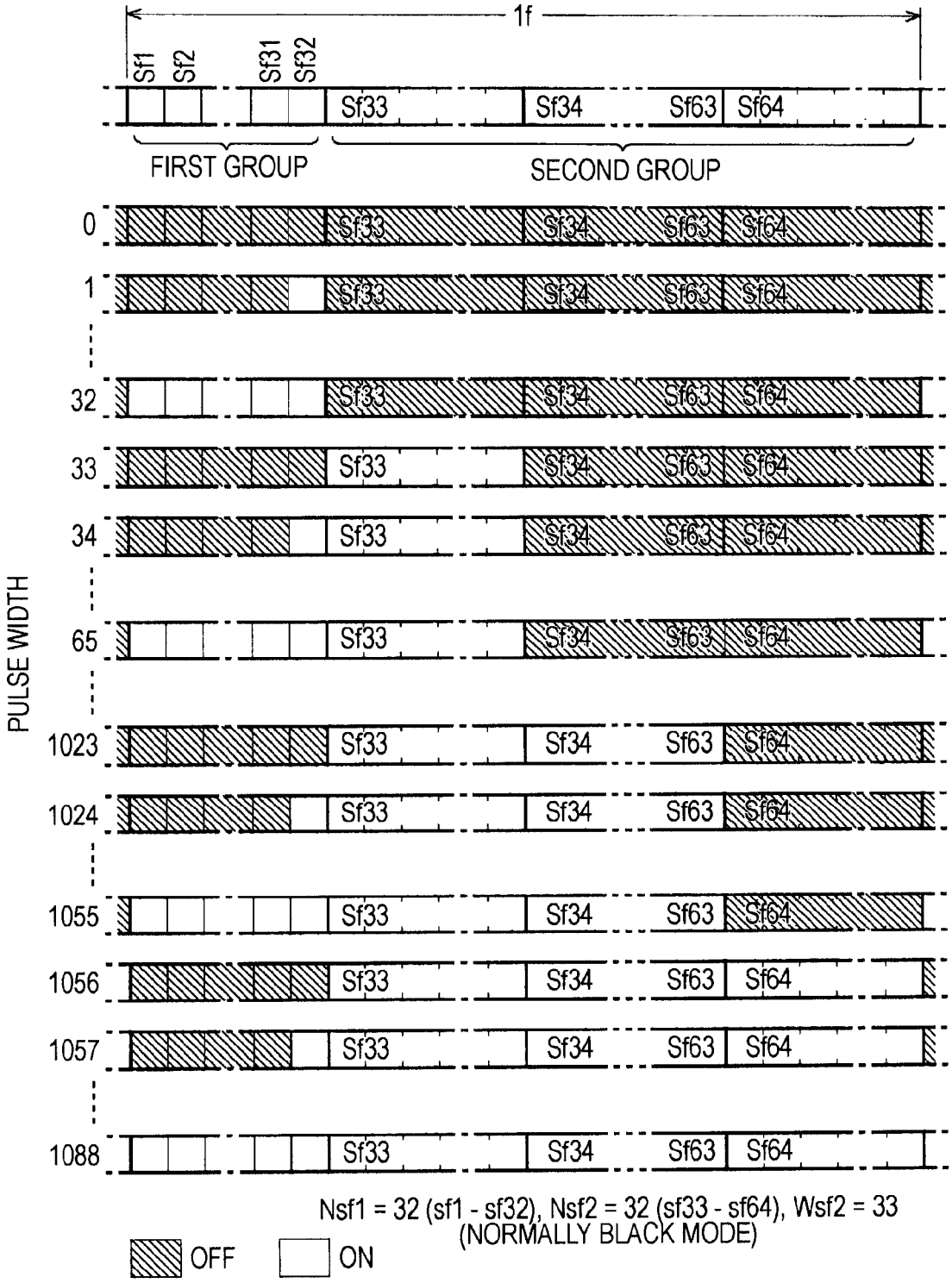
FIG. 12 is a diagram illustrating the configuration of another field.

In the example, the number Nsf of sub-fields constituting one field is "64". As shown in FIG. 12, the sub-fields are arranged temporally in descending order in order of sf64, sf63, . . . , sf34, sf33, sf32, sf31, . . . , sf2, and sf1. The sub-fields belonging to the second group are formed by sf64 to sf33 and the sub-fields belonging to the first group are formed by sf32 to sf1.

On the other hand, the number of scanning lines is "1080" in the example. Accordingly, when "1080" as the number of scanning lines are divided into 33:33: . . . :33:33:1:1: . . . :1:1 as a ratio of the period lengths of the sub-fields sf64, sf63, . . . , sf34, sf33, sf32, sf31, . . . , sf2, and sf1 which are arranged temporally in descending order, the number of interlaced rows of 33, 33, . . . , 33, 33, 1, 1, . . . , 1, 1 can be obtained.

FIG. 12 is a diagram illustrating how the sub-fields to which ON voltage is applied are assigned to the pulse widths in the example, respectively. The pulse width refers to a ratio (ON voltage application ratio) of periods in which the ON voltage is applied in one field (1f). In the example, since it is assumed that the division number is "1088", the pulses widths take values from "0" to "1088". In the example, the liquid crystal element 120 is in the normally black mode in which a dark state (OFF state) is formed when OFF voltage is maintained and a bright state (ON state) is formed when ON voltage is maintained.

Accordingly, in FIG. 12, the ON state and OFF state are reverse in comparison with the normally white mode in FIG. 5. The same is applied to an example in FIG. 13 which will be described later.

The gray scale level which will satisfy transmissivity of the gamma characteristic is selected among the pulse widths from "0" to "1088". Specifically, the gamma characteristic is shown in FIG. 11, when 256 gray scales are expressed. Therefore, 256 gray scale levels which will satisfy the transmissivity according to the corresponding gamma characteristic are selected among the pulse widths from "0" to "1088".

However, like the embodiment described above, when one voltage is used as the ON voltage, resolution cannot be ensured in an area where the gray scale level is low. Therefore, as indicated by a dashed line in FIG. 11, a problem may occur in that the transmissivity for the selected gray scale level is higher than an ideally-considered gamma characteristic.

In order to solve this problem, in the invention, approach to the gamma characteristic may be made by allowing the ON voltage (second voltage) in the sub-field at least most distant from a boundary between the first and the second groups among the sub-fields belonging to the second group to be higher than the ON voltage (first voltage) in another sub-field.

Figure 13:
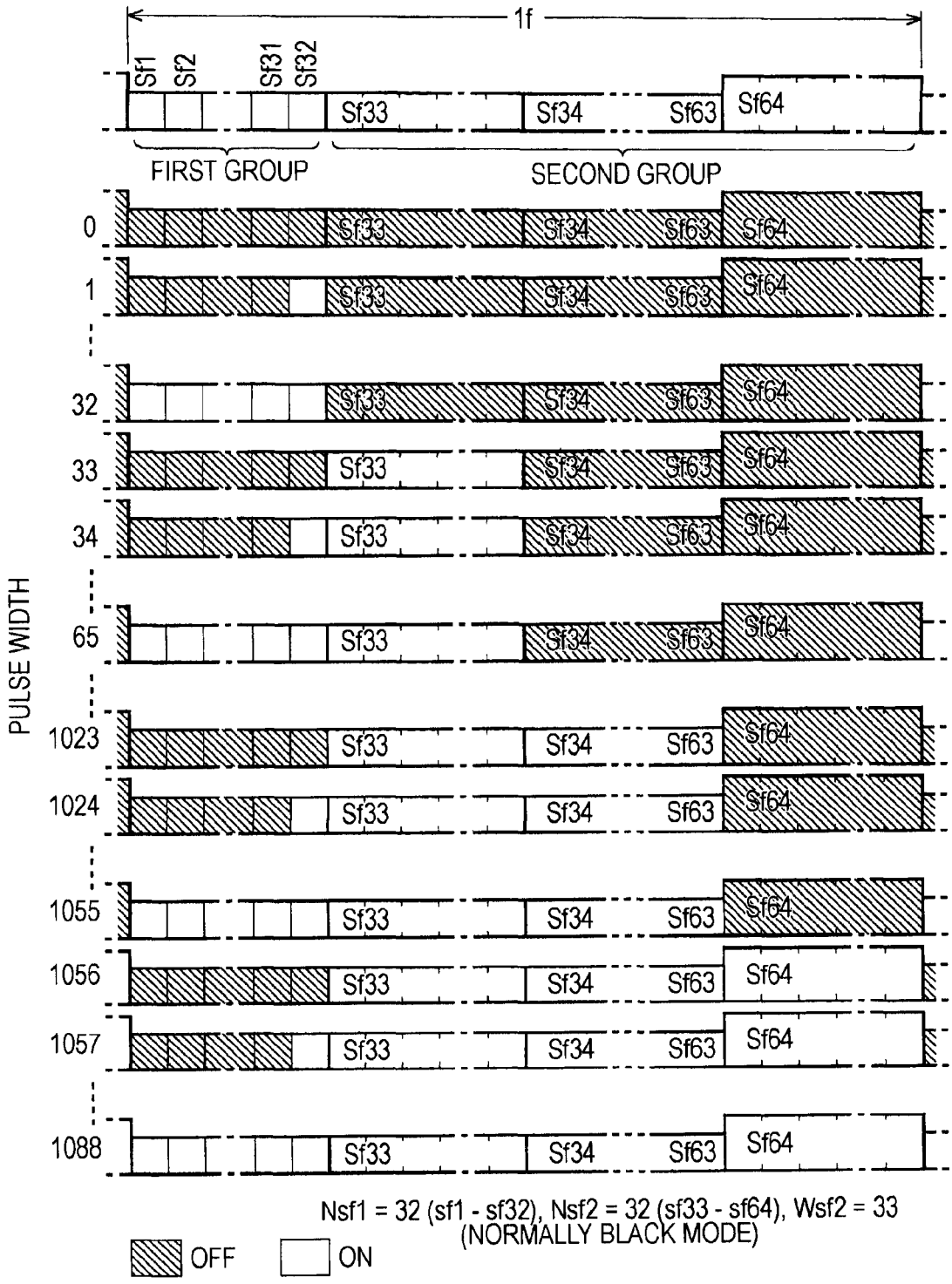
FIG. 13 is a diagram illustrating the configuration of the field.

In the example in which the number of scanning lines is "1080" and the division number is "1088", the sub-field sf64 is most distant from the boundary between the first and second groups. Therefore, when the gray scale level is gradually increased in the normally black mode, the sub-field sf64 becomes the ON state last, as shown in FIG. 12. The ON voltage in the sub-field sf64 which becomes the ON state last is made higher than that of the other sub-fields to make brighter, as shown in FIG. 13. In FIG. 13, a state where the ON voltage becomes higher by making the sub-field sf64 taller than the other sub-fields in vertical direction is shown.

Figure 14:
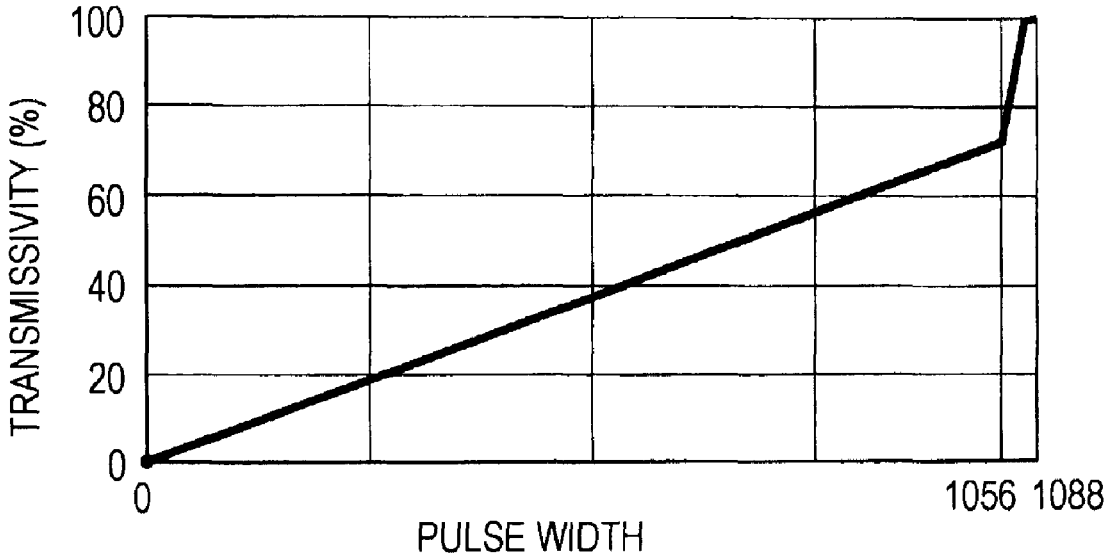
FIG. 14 is a diagram illustrating a characteristic in the configuration of the field.

When the ON voltage in the sub-field sf64 is made higher than that of the other sub-fields, the characteristic of the transmissivity for the pulse width is obtained, as shown in FIG. 14. That is, an interval of the transmissivity for a change in the pulse width is increased in an area where the transmissivity is high, but decreased in an area where the transmissivity is low.

Accordingly, when the ON voltage in the sub-field sf64 is made higher than that of the other sub-fields, it is easy to select 256 gray scale levels which will satisfy the transmissivity according to the gamma characteristic of FIG. 11, compared to the case where one ON voltage is used.

In this way, it is possible to ensure the resolution for the transmissivity in the area where the gray scale level is low, by allowing the ON voltage of the sub-field sf64 belonging to the second group to be higher than the ON voltage of the other sub-fields. Moreover, it is possible to ensure a difference between the lowest gray scale level and the highest gray scale level, that is, a dynamic range.

As a method of making the ON voltage higher, there is considered a method of allowing the application voltage of the common electrode 108 to be uniform by simplifying the pixels 110 and applying a data signal making the ON voltage relatively low or making the ON voltage relatively high with respect to the application voltage of the common electrode 108 in terms of an absolute value to the pixel electrodes 118 through the data lines 114 and the transistors 116. In addition, other methods may be considered.

The sub-field for making the ON voltage high is not limited to the sub-field sf64. As described above, the reason for making the ON voltage higher is to allow the interval of the transmissivity for the change in the pulse width to be small in the area where the transmissivity is low. Therefore, in the sub-fields belonging to the second group for making the ON voltage high, two or more sub-fields may continue in a direction facing the boundary from the sub-field most distant from the boundary between the first and second groups. For example, in FIGS. 12 and 13, since the sub-fields face the boundary in order of sf64, sf63, sf62, . . . , the sub-fields for making the voltage high may be set to sf63 and sf64 or set to sf62, sf63, and sf64, for example.

Figure 15A:
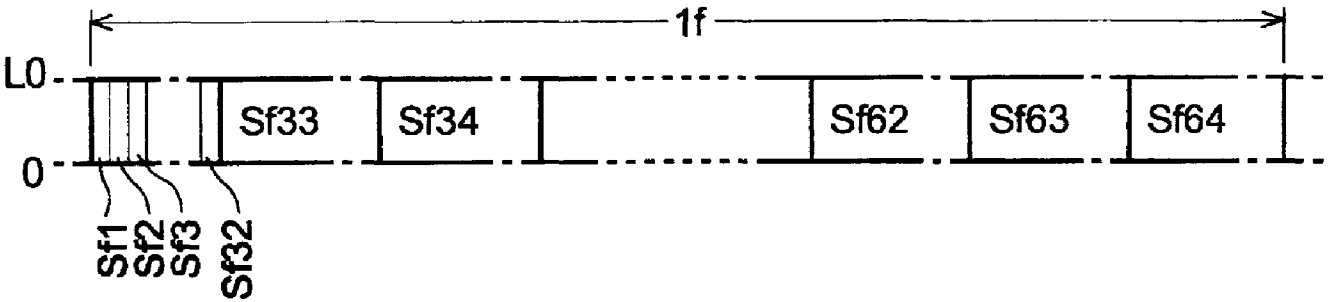
FIGS. 15A and 15B are diagrams illustrating the configuration of another field.
Figure 15B:
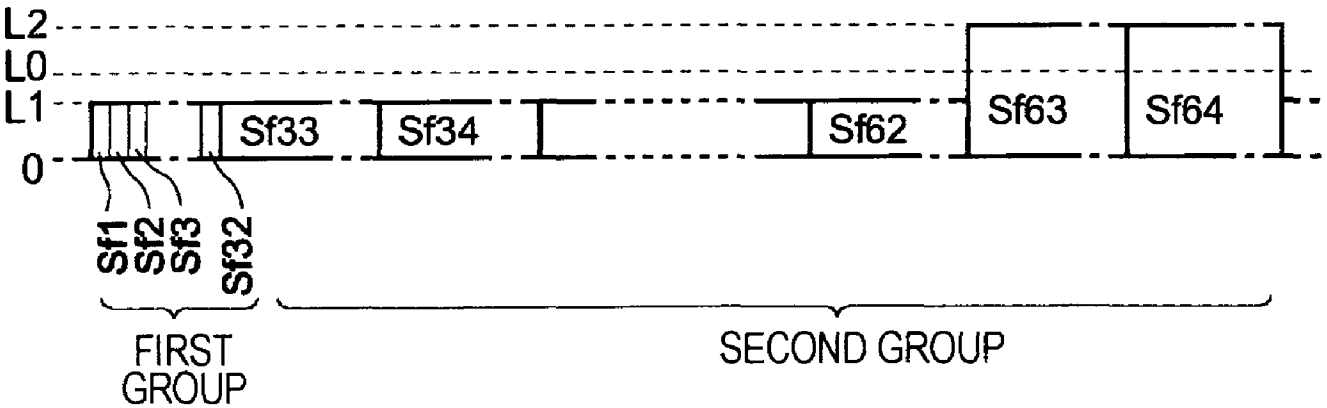

In FIG. 15A, the ON voltage to be applied to one frame is set as one ON voltage L0. In FIG. 15B, the ON voltage to be applied to one frame is set as two ON voltages L1 and L2. In FIG. 14B, in order to allow the characteristic of the pixel transmissivity to approach the gamma characteristic, only the sub-fields of the ON voltage L1 lower than the ON voltage L0 are used when the gray scale level is low, and the sub-fields of the ON voltage L2 higher than the ON voltage L0 when the gray scale level is high. In FIG. 14B, the sub-fields for making the ON voltage high are set to sf63 and sf64. In this way, it is possible to ensure the resolution for the transmissivity in the area where the gray scale level is low. Moreover, it is possible to ensure the difference between the lowest gray scale level and the highest gray scale level, that is, the dynamic range.

Figure 16:
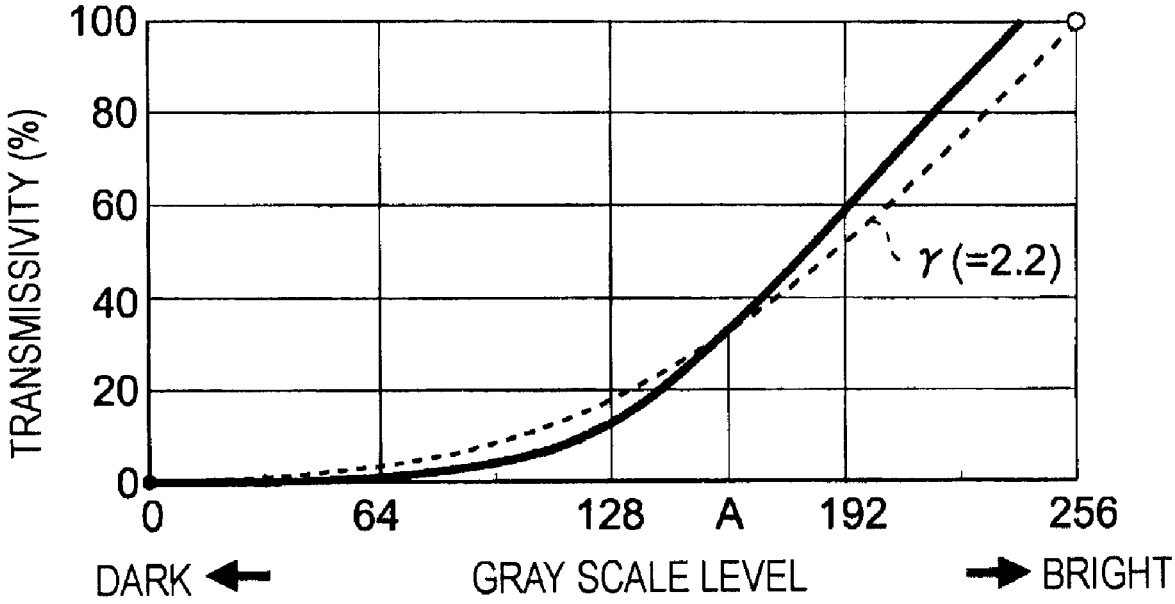
FIG. 16 is a diagram illustrating transmissivity (brightness) with respect to a gray scale level in the configuration of the field.

When the gray scale levels are below A on the assumption that the switched gray scale level is A in FIG. 16, the ON voltage L1 may be determined so as to be lower than the gamma characteristic (see a dashed line) in which the gamma coefficient is 2.2, for example. When the gray scale level is above A, the ON voltage L2 is determined so as to be higher than the gamma characteristic in which the gamma coefficient is 2.2 and thus characteristic may be obtained as indicated by a full line.

With such characteristics, since the resolution can be increased when the low gray scale level is designated and brightness can be obtained when the high gray scale level is designated. Therefore, it is possible to obtain a high display performance in the area where the gray scale level is low and in the area where the gray scale level is high.

When the ON voltage in one sub-field is made high, it is preferable that a voltage effective value obtained when the ON voltage is applied in all the sub-fields constituting one field (1f) including the sub-fields for making the corresponding ON voltage high is equal to or higher than a voltage effective value obtained when a single ON voltage is applied to all the sub-fields.

The liquid crystal element 120 in the pixels is not limited to the transmissive type unit, but may be reflective type The display elements are not limited to the liquid crystal element 120, but an element which becomes the ON state or the OFF state in accordance with the data bits may be used. For example, the invention is applicable to an organic EL element, an electrophoretic element (so-called electronic paper), and a mirror element determining a location where slant of a mirror corresponds to ON/OFF and reflecting incident light in a predetermined direction in only a state between the ON or OFF State.

Electronic Apparatus

Figure 17:
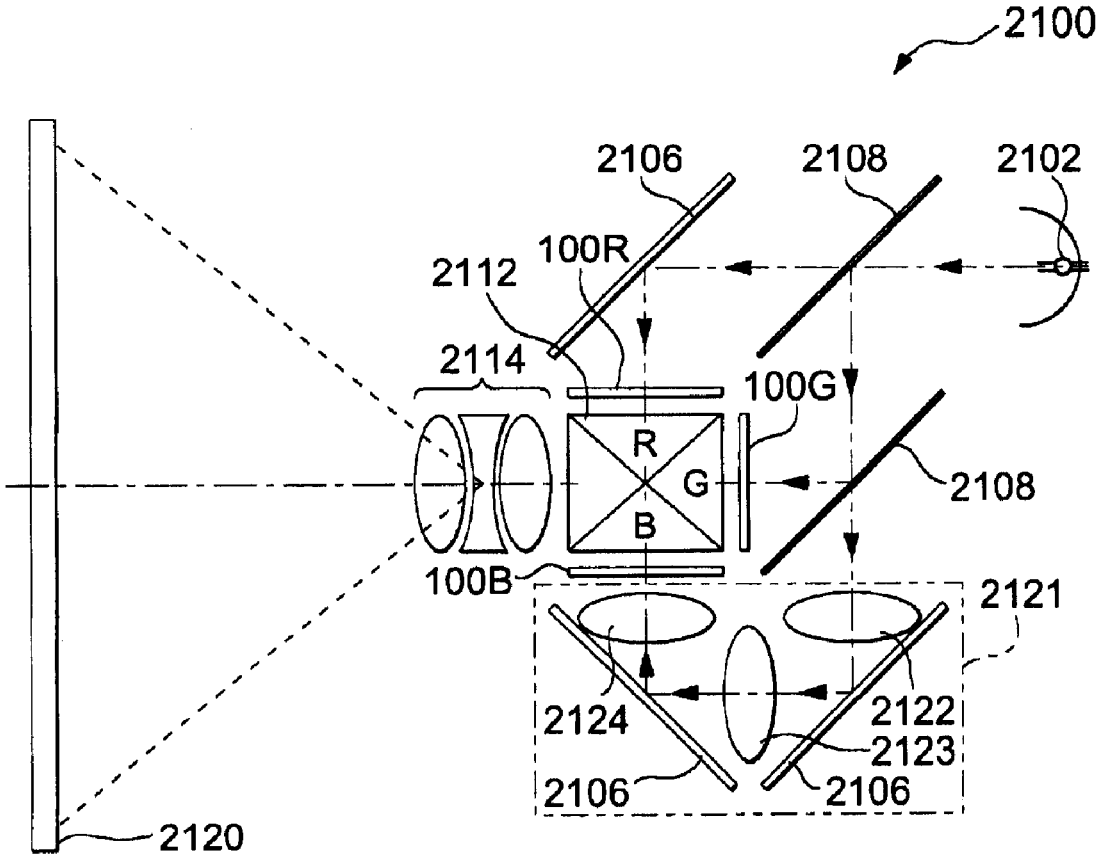
FIG. 17 is a diagram illustrating the configuration of a projector used in the electro-optic device according to the embodiment.

Next, as an example of an electronic apparatus using the electro-optic device according to the embodiment described above, a projector using the electro-optic device as a light valve will be described. FIG. 17 is a top view illustrating the configuration of the projector.

As shown in FIG. 17, a lamp unit 2102 formed by a white light source such as a halogen lamp is provided in a projector 2100. Transmissive light output from the lamp unit 2102 is separated into three primary colors of R (read), G (green), and B (blue) by three mirrors 2106 and two dichroic mirrors 2108 and guided to light valves 100R, 100G, and 100B corresponding to the three primary colors, respectively. When B light is compared to R light or G light, a light path of the B light is longer. Therefore, in order to prevent the loss, the B light is guided through a relay lens system 2121 including an incident lens 2122, a relay lens 2123, and an output lens 2124.

In the projector 2100, three electro-optic device including the display panel 100 are provided in correspondence with respective colors of R, G, and B. Display data corresponding to the respective colors of R, G, and B are supplied from an external high order circuit and stored in field memories. The configuration of the light valves 100R, 100G, and 100B is the same as that of the display panel 100 according to the embodiment described above and the sub-fields are each driven by data bits corresponding to R, G, and B.

Light modulated by the light valves 100R, 100G, and 100B is incident on a dichroic prism 2112 from three directions. In addition, in the dichroic prism 2112, R color light and B color light are refracted by 90° and G color light goes straight. Accordingly, after the images of respective colors are synthesized, a color image is projected through a projection lens 2114 onto a screen 2120.

Since light corresponding to the respective primary colors of R, G, and B are incident on the light valves 100R, 100G, and 100B by a dichroic mirror 2108, a color filter is not necessary. A projection image of the light valves 100R and 100B are projected after light is reflected by the dichroic prism 2112. However, a projection image of the light valve 100G is projected without reflection. Therefore, since a horizontal scanning direction by the light valves 100R and 100B is reverse to a horizontal scanning direction by the light valve 100G, an image reversed right and left is displayed.

Examples of the electronic apparatus include a television, a view finder type or monitor direct vision-type video recorder, a car navigation apparatus, a pager, an electronic pocket book, a calculator, a word processor, a workstation, a television phone, a POS terminal, a digital still camera, a cellular phone, and an apparatus having a touch panel in addition to the projector described with reference to FIG. 17. The electro-optic device according to the invention is applicable to the various electronic apparatus.

What is claimed is:

1. An electro-optic device which includes pixels disposed in regions corresponding to intersections between a plurality of scanning lines (Rreal) and a plurality of data lines, the pixels being turned on or off in accordance with data signals, each of the data signals being supplied to the plurality of data lines when the plurality of scanning lines (Rreal) are selected, in which one field is divided into a plurality of sub-fields (Nsf) and the plurality of sub-fields (Nsf) are classified into a first group having a period length formed by equally dividing the one field into a plurality of slots, such that a number of slots in the one field is a division number (Ndiv), and a second group having a period length that is at least four times longer than a period length of the first group, and in which gray scales are controlled in the one field by turning on or off the pixels in each of the plurality of sub-fields (Nsf), the electro-optic device comprising:

a scanning line driving circuit which, on the assumption that a quantity of the plurality of virtual scanning lines (Rvir) is greater than or equal to a quantity of the plurality of scanning lines (Rreal), performs interlaced scanning on the plurality of virtual scanning lines (Rvir) by the plurality of scanning lines (Rreal) according to a ratio of the period lengths of the plurality of sub-fields (Nsf) arranged in the one field; and a data line driving circuit which supplies the data signals to the pixels located in a region corresponding to selected scanning lines through the plurality of data lines, when two different values obtained as the division number (Ndiv) of the one field are compared to each other, the division number (Ndiv) is selected such that a quantity of a plurality of reference interlaced scanning lines (Ys) is smaller in the interlaced scanning than a selection period obtained by dividing the one field period by the product of the plurality of sub-fields (Nsf) and the plurality of virtual scanning lines (Rvir).

2. The electro-optic device of claim 1, the division number (Ndiv) in which the selection period is longer is larger than the division number (Ndiv) in which the selection period is shorter.

3. The electro-optic device of claim 2, when a value obtained by dividing the plurality of scanning lines (Rreal) by the division number (Ndiv) does not have a decimal fraction, the value is determined as the plurality of reference interlaced scanning lines (Ys), and when a value obtained by dividing the plurality of scanning lines (Rreal) by the division number (Ndiv) has a decimal fraction, an integer value obtained by rounding up the value to the left of the decimal point is determined as the plurality of reference interlaced scanning lines (Ys), the plurality of virtual scanning lines (Rvir) being equal to (Ndiv) multiplied by (Ys), assuming that a weight Wsf1 of the period length of the sub-fields belonging to the first group is 1, an integer value obtained by rounding off a square root of the division number (Ndiv) to the left of the decimal point is determined as a weight Wsf2 of the period lengths of the sub-fields belonging to the second group, and assuming that the number of sub-fields belonging to the first group is Nsf1 and the number of sub-fields belonging to the second group is Nsf2, the number Nsf2 of sub-fields belonging to the second group is equal to {(Ndiv/Wsf2)−1} (where an integer value obtained by rounding up a result value of (Ndiv/Wsf2)−1 to the left of the decimal point is used) and the number Nsf1 of sub-fields belonging to the first group is equal to {Ndiv−Wsf2.times.Nsf2}, and thus the plurality of sub fields (Nsf) is equal to (Nsf1+Nsf2).

4. The electro-optic device of claim 1, a period length of an ON state or an OFF state are set in accordance with a gray scale level, so that the sub-fields which are in an ON state or the subfields which are in an OFF state, and which are located at a direction away from a predetermined reference position, continue in either the ON state or the OFF state.

5. The electro-optic device of claim 4, at least one sub-field among the plurality of sub-fields (Nsf) being normally in the OFF state.

6. The electro-optic device of claim 4, at least one sub-field among the plurality of sub-fields (Nsf) being normally in the ON state.

7. The electro-optic device of claim 4, wherein a first voltage is used as an ON voltage of the sub-fields belonging to the first group, and a second voltage, that is higher than the first voltage, is used as an ON voltage of the sub-fields belonging to the second group, and the second voltage is used in two or more sub-fields which are most distant from the predetermined reference position among the sub-fields belonging to the second group and the subfields continue in a direction facing the predetermined reference position from the sub-field most distant from the predetermined reference position.

8. A method of driving an electro-optic device which includes pixels disposed in regions corresponding to intersections between a plurality of scanning lines (Rreal) and a plurality of data lines, the pixels being turned on or off in accordance with data signals, each of the data signals being supplied to the plurality of data lines when the plurality of scanning lines (Rreal) are selected, in which one field is divided into a plurality of sub-fields (Nsf) and the plurality of sub-fields (Nsf) are classified into a first group having a period length formed by equally dividing the one field into a plurality of slots, such that a numbers of slots in the one field is a division number (Ndiv), and a second group having a period length that is at least four times longer than a period length of the first group, and in which gray scales are controlled in the one field by turning on or off the pixels in each of the plurality of sub-fields (Nsf), the method comprising:

performing interlaced scanning on the plurality of virtual scanning lines (Rvir) by the plurality of scanning lines (Rreal) according to a ratio of the period lengths of the plurality sub-fields (Nsf) arranged in the one field, on the assumption that a quantity of the plurality of virtual scanning lines (Rvir) is greater than or equal to a quantity of the plurality of scanning lines (Rreal); and supplying the data signals to the pixels located in a region corresponding to selected scanning lines through the plurality of data lines, when two different values obtained as the division number (Ndiv) of the one field are compared to each other, the division number (Ndiv) is selected such that a quantity of a plurality of reference interlaced scanning lines (Ys) is smaller in the interlaced scanning than a selection period obtained by dividing the one field period by the product of the plurality of sub-fields (Nsf) and the plurality of virtual scanning lines (Rvir).

9. An electronic apparatus comprising the electro-optic device of claim 1.

10. A method of achieving improved gray scale performance in an electro-optic device which includes pixels provided in regions corresponding to intersections between a plurality of scanning lines (Rreal) and a plurality of data lines, the pixels being turned on or off in accordance with data signals, each of the data signals being supplied to the plurality of data lines when the plurality of scanning lines (Rreal) are selected, in which one field is divided into a plurality of sub-fields (Nsf) and the plurality of subfields (Nsf) are classified into a first group having a period length formed by equally dividing the one field into a plurality of slots, such that a number of slots in the one field is a division number (Ndiv), and a second group having a period length that is at least four times longer than a period length of the first group, and in which gray scales are controlled in the one field by turning on or off the pixels in each of the plurality of sub-fields (Nsf), the method comprising:

performing interlaced scanning on a plurality of virtual scanning lines (Rvir) based on a ratio of the period lengths of the sub-fields arranged in the one field; and supplying the data signals to the pixels located in a region corresponding to selected scanning lines through the plurality of data lines, wherein (Rvir) is greater than or equal to (Rreal), and wherein the value of (Ndiv) that is selected corresponds to a discontinuity in one of the plurality of scanning lines selection time.

* * * * *